US009012116B2

(12) United States Patent
Yamashita et al.

(10) Patent No.: US 9,012,116 B2
(45) Date of Patent: Apr. 21, 2015

(54) TONER AND DEVELOPER

(71) Applicants: Daiki Yamashita, Kanagawa (JP); Yoshihiro Moriya, Shizuoka (JP); Yukiko Nakajima, Kanagawa (JP); Taichi Nemoto, Shizuoka (JP); Yoshitaka Yamauchi, Shizuoka (JP); Keiji Makabe, Shizuoka (JP); Masahide Yamada, Shizuoka (JP); Suzuka Amemori, Shizuoka (JP)

(72) Inventors: Daiki Yamashita, Kanagawa (JP); Yoshihiro Moriya, Shizuoka (JP); Yukiko Nakajima, Kanagawa (JP); Taichi Nemoto, Shizuoka (JP); Yoshitaka Yamauchi, Shizuoka (JP); Keiji Makabe, Shizuoka (JP); Masahide Yamada, Shizuoka (JP); Suzuka Amemori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/755,489

(22) Filed: Jan. 31, 2013

(65) Prior Publication Data

US 2013/0244167 A1 Sep. 19, 2013

(30) Foreign Application Priority Data

Mar. 16, 2012 (JP) ..... 2012-059842

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/0825* (2013.01); *G03G 9/08795* (2013.01); *G03G 9/08797* (2013.01)

(58) Field of Classification Search
USPC ..... 430/109.1
See application file for complete search history.

(56) References Cited

U.S. PATENT DOCUMENTS

| | | | |
|---|---|---|---|
| 2008/0227002 | A1 | 9/2008 | Moriya et al. |
| 2009/0003885 | A1 | 1/2009 | Sabu et al. |
| 2011/0065036 | A1 | 3/2011 | Inoue et al. |
| 2011/0281213 | A1 | 11/2011 | Sakashita et al. |
| 2012/0231383 | A1 | 9/2012 | Santo et al. |
| 2012/0295188 | A1 | 11/2012 | Nakajima et al. |

FOREIGN PATENT DOCUMENTS

| | | |
|---|---|---|
| JP | 59-096123 | 6/1984 |
| JP | 7-033861 | 2/1995 |
| JP | 7-120975 | 5/1995 |
| JP | 2001-166537 | 6/2001 |
| JP | 2008-262179 | 10/2008 |

*Primary Examiner* — Peter Vajda
(74) *Attorney, Agent, or Firm* — Oblon, McClelland, Maier & Neustadt, L.L.P.

(57) ABSTRACT

A toner including a binder resin having a glass transition temperature (Tg) observed at least at one point from 25 to 65° C. in a differential scanning calorimeter at a rate of temperature increase of 5° C./min, wherein the toner has a structure in which a structure appearing as a high phase difference image is dispersed in a structure appearing as a low phase difference image in a two-dimensional phase difference image observed by tapping mode AFM, and an X-ray diffraction chart in which a peak originated from an crystalline resin is observed in a range of a diffraction angle 2θ of from 20 to 25°, and wherein a ratio (I1/I2) of an intensity of the peak originated from an crystalline resin to an intensity (I2) of a halo originated from an amorphous composition is from 0.2 to 1.

13 Claims, 6 Drawing Sheets

TONER AND DEVELOPER

CROSS-REFERENCE TO RELATED APPLICATIONS

This patent application is based on and claims priority pursuant to 35 U.S.C. §119 to Japanese Patent Application No. 2012-059842, filed on Mar. 16, 2012, in the Japan Patent Office, the entire disclosure of which is hereby incorporated by reference herein.

BACKGROUND OF THE INVENTION

1. Field of the Invention

The present invention relates to a toner and a developer used in electrophotographic image forming apparatuses such as copiers, facsimiles and printers; and to an image forming apparatus and an image forming method using them.

2. Description of the Related Art

In an electrophotographic image forming apparatus or electrostatic recording device, an electric or magnetic latent image is developed into a toner image. For example, in electrophotography, an electrostatic latent image is formed on a photoreceptor and is developed into a toner image. The toner image is transferred onto a recording medium, such as paper, and fixed thereon by application of heat, etc.

Japanese Patent No. JP-2909873-B1 (Japanese published unexamined application No. JP-H07-120975-A) describes a toner including a polylactic acid as a binder resin. Polylactic acids, derived from plant resources, are widely used and easily available. Japanese Patent Nos. JP-3347406-B1 (Japanese published unexamined application No. JP-H07-033861-A) and Japanese published unexamined application No. JP-S59-096123-A describe that polylactic acid is obtainable by dehydration condensation of lactic acid monomer or ring-opening polymerization of cyclic lactide of lactic acid. Polylactic acid generally includes a larger content of ester groups than polyester resin. Ester group consists of carbon atoms only. It may be difficult to adjust toner properties with polylactic acids only.

Attempts to use polylactic acid in combination with another resin or to copolymerize polylactic acid with another resin have been made. Japanese Patent No. JP-3785011-B1 (Japanese published unexamined application No. JP-2001-166537-A) describes a toner including a biodegradable polylactic acid-based biodegradable resin in combination with a terpene phenol copolymer. Polylactic acids are poorly compatible with or dispersible in polyester resins or styrene-acrylic copolymers that are widely used as binder resins. This may be disadvantageous in terms of controllability of toner surface composition that has an influence on toner properties such as storageability, chargeability, and fluidity.

Japanese Patent Application Publication No. JP-2008-262179-A describes a toner including a block copolymer resin of a polyester having a polylactic acid backbone having a specific D/L ratio with another polyester, in combination with another resin. However, the binder resin using the polylactic acid does not always have high toughness, and background fouling and toner scattering occur due to low toughness when stirred for long periods.

Typically, the binder resin used in a toner is required to have toughness besides chargeability and fixability. When a resin having insufficient toughness is used in a toner, the toner cracks or lacks due to contact stress. A lacked toner is likely to expose an inner wax component having a low melting point, and electrostatically or non-electrostatically remains on a carrier, resulting in toner filming. The carrier contaminated thereby deteriorates in chargeability, resulting in background fouling, i.e., printed toner on a blank part. Similarly, a charge quantity a toner can obtain from a carrier decreases and capability of electrostatically retaining a toner on the surface of a carrier deteriorates, resulting in known toner scattering in apparatus. Even the binder resin using the polylactic acid does not satisfactorily improve durability of the toner against stress when stirred for long periods. Further, in terms of energy saving, reduction of an energy required to fix a toner image is being more demanded.

Because of these reasons, a need exist for a toner using a polylactic backbone as a binder resin and having lower fixable minimum temperature without being solidified when stored for long periods, background fouling, filming and scattering.

SUMMARY OF THE INVENTION

Accordingly, one object of the present invention to provide a toner using a polylactic backbone as a binder resin and having lower fixable minimum temperature without being solidified when stored for long periods, background fouling, filming and scattering.

Another object of the present invention to provide a method of preparing the toner.

A further object of the present invention to provide a developer using the toner.

Another object of the present invention to provide an image forming method using the toner.

A further object of the present invention to provide a process cartridge using the toner.

These objects and other objects of the present invention, either individually or collectively, have been satisfied by the discovery of a toner comprising a binder resin having a glass transition temperature Tg observed at least at one point from 25 to 65° C. in a differential scanning calorimeter at a rate of temperature increase of 5° C./min, wherein the toner has a structure in which a structure appearing as a high phase difference image is dispersed in a structure appearing as a low phase difference image in a two-dimensional phase difference image observed by tapping mode AFM, and an X-ray diffraction chart in which a peak originated from an crystalline resin is observed in a range of a diffraction angle 2θ of from 20 to 25°, and wherein a ratio (I1/I2) of an intensity of the peak originated from an crystalline resin to an intensity (I2) of a halo originated from an amorphous composition is from 0.2 to 1.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
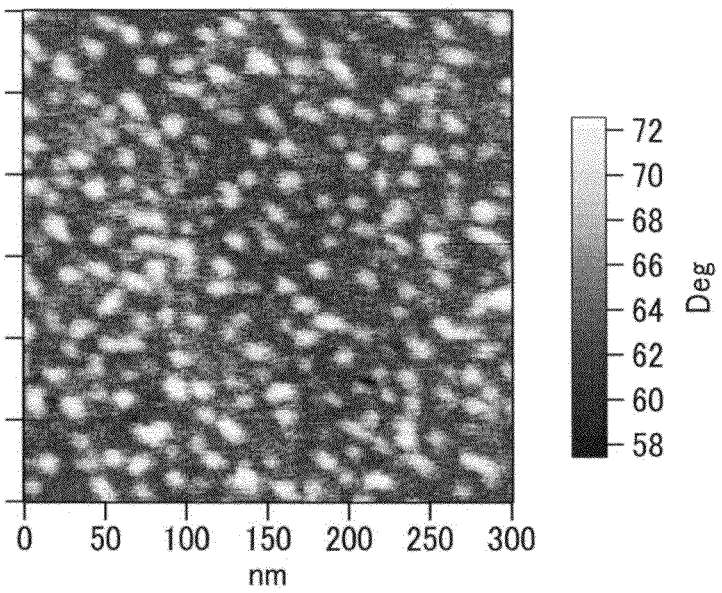
FIG. 1 is a TEM photograph showing a representative two-dimensional phase image of a binder resin in the present invention.

The present invention provides a toner using a polylactic backbone as a binder resin and having lower fixable minimum temperature without being solidified when stored for long periods, background fouling, filming and scattering.

More particularly, the present invention relates to a toner comprising a binder resin having a glass transition temperature Tg observed at least at one point from 25 to 65° C. in a differential scanning calorimeter at a rate of temperature increase of 5° C./min, wherein the toner has a structure in which a structure appearing as a high phase difference image is dispersed in a structure appearing as a low phase difference image in a two-dimensional phase difference image observed by tapping mode AFM, and an X-ray diffraction chart in which a peak originated from an crystalline resin is observed in a range of a diffraction angle 2θ of from 20 to 25°, and wherein a ratio (I1/I2) of an intensity of the peak originated from an crystalline resin to an intensity (I2) of a halo originated from an amorphous composition is from 0.2 to 1.

An average domain size in a dispersion phase of the high phase difference is preferably not less than 10 nm and less than 45 nm.

In order to improve toughness of a binder resin, the resin needs to have a structure absorbing deformation and pressure from outside inside. As a means for this, e.g. the resin has a softer structure. For example, a rubber-like binder resin at room temperature is preferably used. However, in this case, the binder resin needs to have a glass transition temperature lower than actual use temperature, and the resultant toner melts and adheres while stored, i.e., blocking tends to occur. Meanwhile, in order to prevent toner blocking in actual use temperature, the glass transition temperature needs to be at least not less than the actual use temperature. Therefore, in order to improve both toughness and storageability of the resin, this trade-off relation needs dissolving.

In the present invention, a low Tg unit effectively absorbing stress and improving toughness is finely dispersed in a phase of a high Tg unit effectively improving storageability of a toner to dissolve the trade-off relation.

As a structure of the binder resin capable of realizing the dispersion, a block copolymer of a polyester backbone A having a repeating unit obtained from a dehydration condensation of a polyhydroxycarboxylic acid and a backbone B having no repeating unit obtained from a dehydration condensation of a polyhydroxycarboxylic acid is effectively used for dispersing a fine and clear low-Tg unit.

The polyester backbone A having a repeating unit obtained from a dehydration condensation of a polyhydroxycarboxylic acid has a configuration in which a single polyhydroxycarboxylic acid is polymerized or multiple polyhydroxycarboxylic acids are copolymerized. The polyester backbone A can be obtained from a hydrolysis condensation of a polyhydroxycarboxylic acid or a ring-opening polymerization of a cyclic ester of the polyhydroxycarboxylic acid, for example. The polyester backbone A is obtained from a ring-opening polymerization of cyclic esters of polyhydroxycarboxylic acids. In such embodiments, molecular weight of the resultant polyhydroxycarboxylic acid backbone can be increased. In one or more embodiments, the polyhydroxycarboxylic acid backbone is obtained from an aliphatic hydroxycarboxylic acid in view of transparency and thermal property. The polyhydroxycarboxylic acid backbone is obtained from a hydroxycarboxylic acid having 2 to 6 carbon atoms, such as lactic acid, glycolic acid, 3-hydroxybutyric acid, or 4-hydroxybutyric acid. The lactic acid is preferably used in view of transparency and compatibility with resins.

When cyclic esters of hydroxycarboxylic acids are used, the resultant polyhydroxycarboxylic acid backbone has a configuration in which the hydroxycarboxylic acids are polymerized. For example, the polyhydroxycarboxylic acid backbone obtained from lactic acid lactide has a configuration in which lactic acid is polymerized.

The polyester backbone A having a repeating unit obtained from a dehydration condensation of a polyhydroxycarboxylic acid is a polylactic acid backbone. A polylactic acid is a polymer in which lactic acid is bonded with ester bonds. Polylactic acids are recently receiving attentions as environment-friendly biodegradable plastics. Because an enzyme for cutting ester bonds (i.e., esterase) is widely distributed in nature, polylactic acids are gradually decomposed into lactic acids and finally decomposed into carbon dioxide and water.

In a polylactic resin composition, an optical isomer ratio X (%) at a monomer component conversion represented by the following formula is preferably not greater than 80%.

$$X(\%)=|X(L\text{-form})-X(D\text{-form})|$$

wherein X(L-form) and X(D-form) represent ratios (%) of L-form and D-form at a polylactic monomer conversion, respectively.

The optical isomer ratio X can be measured as follows. First, mix an analyte (e.g., a resin or toner having a polyester backbone) with a mixture solvent of pure water, 1N sodium hydroxide, and isopropyl alcohol and agitate the mixture at 70° C. to cause hydrolysis. Next, filter the mixture to remove solid contents and add sulfuric acid to neutralize the filtrate. Thus, an aqueous solution containing L-form and/or D-form monomers (e.g., L-form and/or D-form lactic acids), which are decomposition products of the analyte (e.g., the polyester resin), is obtained. Subject the aqueous solution to a measurement with a high-speed liquid chromatography (HPLC) equipped with chiral ligand exchangeable columns SUMICHIRAL OA-5000 (from Sumika Analysis Chemical Service, Ltd.). Determine peak areas S(L) and S(D) corresponding to L-form monomer (e.g., L-lactic acid) and D-form monomer (e.g., D-lactic acid), respectively, from the resultant chromatogram. The optical isomer ratio X is calculated from the peak areas as follows.

$$X(L\text{-form})(\%)=100\times S(L)/(S(L)+S(D))$$

$$X(D\text{-form})(\%)=100\times S(D)/(S(L)+S(D))$$

$$\text{Optical isomer ratio } X(\%)=|X(L\text{-form})-X(D\text{-form})|$$

L-form and D-form monomers are optical isomers. Optical isomers are equivalent in physical and chemical properties as well as polymerization reactivity, except for optical properties. The ratio of monomers is equivalent to that in the resultant polymer. When the optical isomer ratio is 80% or less, solvent solubility and transparency of the resin improve.

X(D-from) and X(L-form) are respectively equivalent to the ratios of D-form and L-form monomers used for forming the polyhydroxycarboxylic acid backbone. The optical isomer ratio X (%) of the polyhydroxycarboxylic acid backbone can be controlled by the use of racemic mixture of L-form and D-form monomers.

The polylactic acid resin can be obtained by, for example, preparing a lactic acid by fermenting starch such as corn, and then directly subjecting the lactic acid to a dehydration condensation; or forming a cyclic dimer lactide from the lactic acid and then subjecting the cyclic dimer lactide to a ring-opening polymerization in the presence of a catalyst. In the ring-opening polymerization, the molecular weight of the resultant resin can be controlled by varying the amount of a reaction initiator and the reaction can be terminated within a short time period, which is advantageous in terms of productivity.

A reaction initiator may be, for example, an alcohol regardless of the number of functional groups which does not volatilize even when dried at about 100° C. under a reduced pressure of 20 mmHg or less or even when heated at a high temperature of about 200° C. in the polymerization.

As described above, the backbone B having no repeating unit obtained from a dehydration condensation of a polyhydroxycarboxylic acid has a glass transition temperature of −20° C. or less. In such embodiments, the first binder resin has a Tg1 of −20° C. or less and has a structure in which an inner phase consisting primarily of the backbone B is finely dispersed in an outer phase consisting primarily of the backbone A. The backbone B having no repeating unit obtained from a dehydration condensation of a polyhydroxycarboxylic acid is obtained from a compound having at least two hydroxyl groups. Such a compound functions as a reaction initiator for a ring-opening polymerization of lactide for preparing the first binder resin. When the backbone B is formed from such a compound having at least two hydroxyl groups, the first binder resin has an improved affinity for colorants. When the compound has the high-Tg unit derived from the backbone A on its both ends, it is likely that the low-Tg unit derived from the backbone B is dispersed internally.

The backbone B may be, for example, a backbone of a polyether, a polycarbonate, a polyester, a vinyl resin having a hydroxyl group, or a silicone resin having a terminal hydroxyl group. The backbone B is a polyester backbone in view of affinity for colorant.

The polyester backbone as the backbone B can be obtained from a ring-opening addition polymerization of a polyester obtained from at least one polyol having the following formula (1) and at least one polycarboxylic acid having the following formula (2).

$$A\text{-}(OH)m \quad (1)$$

In the formula (1), A represents an alkyl group, an alkylene group, a substituted or unsubstituted aromatic group, or a heterocyclic aromatic group, having 1 to 20 carbon atoms, and m represents an integer of 2 to 4.

$$B\text{—}(COOH)n \quad (2)$$

In the formula (2), B represents an alkyl group, an alkylene group, a substituted or unsubstituted aromatic group, or a heterocyclic aromatic group, having 1 to 20 carbon atoms, and n represents an integer of 2 to 4.

Specific examples of the polyol having the formula (1) include, but are not limited to, ethylene glycol, diethylene glycol, triethylene glycol, 1,2-propylene glycol, 1,3-propanediol, 1,4-butanediol, neopentyl glycol, 1,4-butenediol, 1,5-pentanediol, 3-methyl-1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6,-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adduct of bisphenol A, propylene oxide adduct of bisphenol A, hydrogenated bisphenol A, ethylene oxide adduct of hydrogenated bisphenol A, and propylene oxide adduct of hydrogenated bisphenol A. These can be used alone or in combination.

Specific examples of the polycarboxylic acid having the formula (2) include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, enpol trimmer acid, cyclohexanedicarboxylic acid, cyclohexenedicarboxylic acid, butanetetracarboxylic acid, diphenylsulfone tetracarboxylic acid, and ethylene glycol bis(trimellitic acid). These can be used alone or in combination.

The polyester backbone as the backbone B is obtained from acid constituents including 1.5% by mol or more of a polycarboxylic acid having three or more valences. Specific examples of the polycarboxylic acid having three or more valences include, but are not limited to, trimellitic acid. By introduction of the polycarboxylic acid having three or more valences, the first binder resin has a branched or cross-linked structure. Thus, the molecular chain of the first binder resin is substantially shortened. With such a branched structure, the domain size of the backbone B that is forming the inner phase can be reduced. Therefore, the average of the maximum Feret diameters among domains of the first phase with a large phase difference observed in an AFM phase image can be also reduced. When the content of the polycarboxylic acid having 3 or more valences is less than 1.5% by mol, the degree of branching is so small that the domain size of the backbone B is unnecessarily increased and therefore the average of the maximum Feret diameters among domains of the first phase with a large phase difference is also unnecessarily increased. As a result, thermostable storageability of the toner may deteriorate.

In addition, the content of the polycarboxylic acid having 3 or more valences is 3% by mol or less. When the content of the polycarboxylic acid having 3 or more valences exceeds 3% by mol, the branched or cross-linked structure gets so complicated that the molecular weight may be unnecessarily increased or solvent solubility may deteriorate.

The inner dispersion state of a binder resin is determined from a two-dimensional phase image obtained by an atomic force microscope (AFM) with a method called tapping mode. Details of the tapping mode of AFM are described in a technical document "Surface Science letter, 290, 668 (1993)". The phase image is obtained by vibrating a cantilever on a surface of a sample as described in technical documents "Polymer, 35, 5778 (1994)" and "Macromolecules, 28, 6773 (1995)".

Depending on viscoelastic property of the measured surface of a sample, a phase difference is generated between a driver that is driving the cantilever and the actual vibration. The phase image is obtained by mapping these phase differences. A phase difference is large in a soft portion. A phase difference is small in a hard portion.

In the binder resin of the present invention, the unit having a lower Tg is observed as a portion with a large phase difference, i.e., a soft portion, and the unit having a higher Tg is observed as a portion with a small phase difference, i.e., a hard portion. It is necessary that the hard portion with a small phase difference forms an outer phase and the soft portion with a large phase difference forms an inner phase in the present invention.

To obtain a phase image with AFM, a block of each sample (i.e., resin) is cut into an ultrathin section with an ultra microtome ULTRACUT (from Leica) under the following conditions. The ultrathin section is subjected to an observation with AFM.

Cutting thickness: 60 nm

Cutting speed: 0.4 mm/sec

Cutting instrument: Diamond knife (Ultra Sonic 35°)

As an AFM instrument, MFP-3D equipped with a cantilever OMCL-AC240TS-C3 (from Asylum Technology Co., Ltd.) can be used under the following conditions.

Target amplitude: 0.5 V

Target percent: −5%

Amplitude set point: 315 mV

Scan rate: 1 Hz

Scan points: 256×256

Scan angle: 0°

As a dispersion diameter of the high phase difference image of the AFM phase image, i.e., soft and low Tg unit, an average of the longest diameter of straight lines of 30 high phase difference images randomly selected is defined as an average domain size. The average domain size needs to be less than 45 nm and preferably not less than 10 nm. When not less than 45 nm, low Tg unit having strong adherence is likely to be exposed due to stress, resulting in worse toner filming on occasion. When less than 10 nm, stress absorbability noticeably weakens, resulting in insufficient improvement of toughness on occasion.

FIG. 1 shows a representative two-dimensional phase image of a binder resin in the present invention.

Measurement of Glass Transition Temperature (Tg)

Instrument: DSC (Q2000 from TA Instruments)

An aluminum simplified sealed pan is filled with 5 to 10 mg of a sample and is subjected to the following procedures.

1st heating: Heat from 3 to 220° C. at a heating rate of 5° C./min and keep at 220° C. for 1 minute.

Cooling: Quench to −60° C. without temperature control and keep at −60° C. for 1 minute.

2nd Heating: Heat from −60 to 180° C. at a heating rate of 5° C./min.

Glass transition temperature is determined from the midpoint observed in the thermogram obtained in the 2nd heating based on a method according to ASTM D3418/82. A Tg point is preferably specified by determining a polar change point from Dr DSC chart in which a first differential is made. The Tg of the binder resin needs to be observed at only one point in a range of temperature in the measurement flow, and the following relationship is satisfied:

$$-5 \leq Tg-[TgA \times MA/(MA+MB)+TgB \times MB/(MA+MB)] \leq 5$$

wherein TgA represents a Tg of the polyester backbone A; TgB represents a Tg of the backbone B having no repeating unit obtained from a dehydration condensation of a polyhydroxycarboxylic acid; and MA and MB represents their weight ratios, respectively.

When the backbone A and the backbone B are compatible with each other, the Tg is typically one according to a mixing ratio thereof. However, since the binder resin of the present invention having a structure in which a soft low Tg unit is dispersed in a harder high Tg unit by AFM, they are not compatible with each other completely. When two units having different Tgs incompatible with each other coexist, the Tg of the binder resin is typically observed at two points. Although having different soft and hard domains, the binder resin of the present invention is thought to have a particular structure in which they are half compatible with each other as a Tg is observed at one point. In the present invention, a binder resin satisfying the above conditions is needed to improve anti-stress (toughness) and thermostable storageability of the resultant toner.

When the Tg is observed at two or more points, the domain size originated from the backbone B which is a low Tg unit is likely to become large. In this case, the resultant toner is likely to deform due to stress when stirred for long periods, and the low Tg unit is likely to be exposed on the surface thereof, which causes adherence thereof to a carrier and an image developer, resulting in background fouling and white stripe images. Even when the Tg satisfies the above formula and is observed at one point, the resin can be judged to have uniform quality in which the backbone A and the backbone B are compatible with each other almost completely when a dispersion of the hard and soft domains is not observed, i.e., an average domain diameter is noticeably small or not present, the effect of the backbone B absorbing stress is noticeably reduced, resulting in occasional background fouling.

The backbone B preferably has a weight ratio of from 5 to 25% based on total weight of the binder resin and a number-average molecular weight of from 1,000 to 2,500 to determine the compatibility.

A ratio of the peak intensity (I1) originated from a crystal and the halo intensity (I2) originated from amorphous is determined as follows. First, at 2θ which is a maximum value of the peak intensity originated from a crystal, both peak intensities are compared. Then, an absolute value of the peak intensity depends on a sample amount, and the sample is used in an amount measurable enough. A ratio of the I1 to I2 is a relative comparison and does not depend on an absolute value. An apparatus measuring an X-ray is not particularly limited, provided it is capable of measuring a range of diffraction angle 2θ of from 20 to 25°. A ratio of the I1 to I2 is from 0.2 to 1.

An X-ray diffraction apparatus equipped with a two-dimensional detector D8 DISCOVER with GADDS from Bruker Corp. is used. Detail conditions are as follows.

Tube current: 40 mA

Tube voltage: 40 kV

Goniometer 2θ axis: 20.0000°

Goniometer Ω axis: 0.0000°

Goniometer ϕ axis: 0.0000°

Detector distance: 15 cm (wide angle measurement)

Measured range: 3.2≤2θ≤37.2

Specific examples of the colorants include known pigments and dyes capable of forming yellow, magenta, cyan and black toners.

Specific examples of yellow pigment include, but are not limited to, cadmium yellow, mineral fast yellow, nickel titanium yellow, Naples yellow, naphthol yellow S, Hansa yellow G, Hansa yellow 10G, benzidine yellow GR, quinoline yellow lake, permanent yellow NCG and tartrazine lake. Specific examples of orange pigments include, but are not limited to, molybdenum orange, permanent orange GTR, pyrazolone orange, Vulcan orange, indanthrene brilliant orange RK, benzidine orange G and indanthrene brilliant orange GK. Specific examples of red pigments include, but are not limited to, iron red, cadmium red, permanent red 4R, lithol red, pyrazolone red, watching red calcium salt, lake red D, brilliant carmine 6B, eosin lake, rhodamine lake B, alizarin lake and brilliant carmine 3B. Specific examples of violet pigments include, but are not limited to, fast violet B and methyl violet lake. Specific examples of blue pigments include, but are not limited to, cobalt blue, alkali blue, Victoria blue lake, phthalocyanine blue, non-metal phthalocyanine blue, phthalocyanine blue-partly chloride, fast sky blue and indanthrene blue BC. Specific examples of green pigments include, but are not limited to, chromium green, chromium oxide, pigment green B and malachite green lake.

Specific examples of black pigments include, but are not limited to, carbon black, oil furnace black, channel black, lamp black, acetylene black, an azine color such as aniline black, metal salt azo color, metal oxide, complex metal oxide.

These colorants can be used alone or in combination.

A toner preferably includes a colorant in an amount of from 1 to 15% by weight, and more preferably from 3 to 10% by weight. When less than 1% by weight, coloring power of the toner may be poor. When the colorant content is greater than 15% by weight, coloring power and electric property of the toner may be poor because the colorant cannot be uniformly dispersed in the toner.

The colorant can be combined with a resin to be used as a master batch. Specific examples of usable resins include, but are not limited to, polyester, polymers of styrene or styrene substituents, styrene-based copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Additionally, polyester resins having a polyhydroxycarboxylic acid backbone are also usable. Such resins are derived from plants. Two or more of these materials can be used in combination. Among these, polymers of styrene or styrene substituents are preferably used.

Specific examples of usable polymers of styrene or styrene substituents include, but are not limited to, polystyrene, poly-p-chlorostyrene, and polyvinyl toluene. Specific examples of the styrene-based copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading a resin and a colorant while applying a high shearing force. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resultant wet cake of the colorant can be used as it is without being dried. When performing the mixing or kneading, a high shearing force dispersing device such as a three roll mill may be used.

Specific materials usable as the release agent include, but are not limited to, wax. Specific examples of usable waxes include, but are not limited to, free-fatty-acid-free carnauba wax, polyethylene wax, montan wax, oxidized rice wax, and combinations thereof. A microcrystalline carnauba wax having an acid value of 5 or less, which can be dispersed in the binder resin with a dispersion diameter of 1 μm or less, is used. A microcrystalline montan wax, obtained by purifying a mineral, having an acid value of 5 to 14 is used. An oxidized rice wax, obtained by oxidizing a rice bran wax with air, having an acid value of 10 to 30 is used. These waxes can be finely dispersed in the resin according to an embodiment, which can provide a toner having a good combination of hot offset resistance, transferability, and durability. Two or more kinds of the above waxes can be used in combination.

Specific materials usable as the release agent further include, but are not limited to, solid silicone wax, higher fatty acid higher alcohol, montan ester wax, polyethylene wax, polypropylene wax, and combinations thereof.

The release agent preferably has a glass transition temperature (Tg) of 70 to 90° C. When Tg is less than 70° C., thermostable storageability of the toner may be poor. When Tg is greater than 90° C., cold-offset resistance of the toner may be poor, i.e., the toner may not be releasable at low temperatures and undesirably winds around a fixing member.

The content of the release agent in the toner is 1 to 20% by weight or 3 to 10% by weight. When the content of the release agent is less than 1% by weight, offset resistance of the toner may be poor. When the content of the release agent is greater than 20% by weight, transferability and durability of the toner may be poor.

The toner of the present invention may include a charge controlling agent when necessary.

Specific examples of usable charge controlling agents include, but are not limited to, nigrosine dyes, azine dyes having an alkyl group having 2 to 16 carbon atoms described in Examined Japanese Application Publication No. 42-1627; basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000)) and lake pigments thereof; quaternary ammonium salts (e.g., C.I. Solvent Black 8 (C.I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385; sulfonated copper phthalocyanine pigments; organic boron salts; fluorine-containing quaternary ammonium salts; and calixarene compounds. Toners having colors other than black include a white metal salt of a salicylic acid derivative.

The content of the charge controlling agent is preferably from 0.01 to 2 parts by weight and more preferably from 0.02 to 1 part by weight based on 100 parts of the binder resin. When the content of the charge controlling agent is 0.01 parts by weight or more, good charge controllability is provided. When the content of charge controlling agent is 2 parts by weight or less, the toner is not excessively charged nor excessively electrostatically attracted to a developing roller, preventing deterioration of fluidity and image density while keeping good charge controllability.

Shape controlling agents can be used to control the shape of toner. Specific materials usable as the shape controlling agent include, but are not limited to, layered inorganic minerals in which at least a part of interlayer ions are modified with an organic ion (hereinafter "modified layered inorganic minerals"). Specific examples of such modified layered inorganic minerals include, but are not limited to, organic-cation-modified smectite-based materials. Metal anions can be introduced to a layered inorganic mineral by replacing a part of divalent metals with trivalent metals. In this case, at least a part of the introduced metal anions may be modified with an organic anion so as not to increase hydrophilicity of the layered inorganic mineral.

Specific materials usable as the organic cation modifying agent include, but are not limited to, quaternary alkyl ammonium salts, phosphonium salts, and imidazolium salts. In one or more embodiments, quaternary alkyl ammonium salts are used. Specific examples of the quaternary alkyl ammonium salts include, but are not limited to, trimethyl stearyl ammonium, dimethyl stearyl benzyl ammonium, and oleylbis(2-hydroxyethyl)methyl ammonium.

Specific materials usable as the organic cation modifying agent further include, but are not limited to, sulfates, sulfonates, carboxylates, and phosphates having a branched, non-branched, or cyclic alkyl (C1-C44), alkenyl (C1-C22), alkoxy (C8-C32), hydroxyalkyl (C2-C22), ethylene oxide, or propylene oxide. In one or more embodiments, carboxylic acids having an ethylene oxide skeleton are used.

The modified layered inorganic mineral has proper hydrophilicity due to the modification by the organic ion. A toner components liquid including such a modified layered inorganic mineral expresses non-Newtonian viscosity, which is capable of controlling or varying the resultant toner shape. The content of the modified layered inorganic mineral in the toner is preferably from 0.05 to 10% by weight and more preferably from 0.05 to 5% by weight.

Specific examples of the modified layered inorganic minerals include, but are not limited to, montmorillonite, bentonite, hectorite, attapulgite, sepiolite, and mixtures thereof. An organic-modified montmorillonite or bentonite is used. They can easily control viscosity of the toner components liquid at a small amount without adversely affecting other toner properties.

Specific examples of commercially available organic-cation-modified layered inorganic minerals include, but are not limited to, quaternium 18 bentonite such as BENTONE® 3, BENTONE® 38, and BENTONE® 38V (from Rheox), TIXOGEL VP (from United Catalyst), and CLAYTONE® 34, CLAYTONE® 40, and CLAYTONE® XL (from Southern Clay Products); stearalkonium bentonite such as BENTONE® 27 (from Rheox), TIXOGEL LG (from United Catalyst), and CLAYTONE® AF and CLAYTONE® APA (from Southern Clay Products); and quaternium 18/benzalkonium bentonite such as CLAYTONE® HT and CLAYTONE® PS (from Southern Clay Products). Among these, CLAYTONE® AF and CLAYTONE® APA are preferably used.

Specific examples of commercially available organic-anion-modified layered inorganic minerals include, but are not limited to, HITENOL 330T (from Dai-ichi Kogyo Seiyaku Co., Ltd.) obtainable by modifying DHT-4A (from Kyowa Chemical Industry Co., Ltd.) with an organic anion represented by the following formula:

$$R1(OR2)nOSO_3M$$

wherein R1 represents an alkyl group having 13 carbon atoms, R2 represents an alkylene group having 2 to 6 carbon atoms, n represents an integer of 2 to 10, and M represents a monovalent metal element.

The toner of the present invention may include external additives for the purpose of improving fluidity, controlling charge quantity and electrical properties, etc. The external additive is appropriately selected from those known in the art depending on the intended purpose without any restriction, and examples thereof include silica particles, hydrophobic silica particles, a fatty acid metal salt (e.g., zinc stearate, and aluminum stearate), metal oxide (e.g., titanium oxide, alumina, tin oxide, and antimony oxide), hydrophobic metal oxide particles, and fluoropolymer. Among them, hydrophobic silica particles, hydrophobic titanium oxide particles, and hydrophobic alumina particles are preferable.

Examples of the silica particles include: HDK H 2000, HDK H 2000/4, HDK H 2050EP, HVK21, and HDK H1303 (all from Hoechst AG); and R972, R974, RX 200, RY200, R202, R805, and R812 (all from Nippon Aerosil Co., Ltd.). Examples of the titanium oxide particles include: P-25 (from Nippon Aerosil Co., Ltd.); STT-30, and STT-65C-S (both from Titan Kogyo, Ltd.); TAF-140 (from Fuji Titanium Industry Co., Ltd.); and MT-150W, MT-500B, MT-600B, and MT-150A (all from TAYCA CORPORATION). Examples of the hydrophobic titanium oxide particles include: T-805 (from Nippon Aerosil Co., Ltd.); STT-30A, and STT-65S-S (both from Titan Kogyo, Ltd.); TAF-500T, and TAF-1500T (both from Fuji Titanium Industry Co., Ltd.); MT-100S, and MT-100T (both from TAYCA CORPORATION); and IT-S (from ISHIHARA SANGYO KAISHA, LTD.).

In order to attain hydrophobic silica particles, hydrophobic titanium oxide particles, and hydrophobic alumina particles, hydrophilic particles (e.g., silica particles, titanium oxide particles, and alumina particles) are treated with a silane coupling agent such as methyltrimethoxy silane, methyltriethoxy silane, and octyltrimethoxy silane.

Specific examples of hydrophobizer include a silane-coupling agent (e.g., dialkyl dihalogenated silane, trialkyl halogenated silane, alkyl trihalogenated silane, and hexaalkyl disilazane), a sililation agent, a silane-coupling agent containing a fluoroalkyl group, an organic titanate-based coupling agent, an aluminum-based coupling agent, silicone oil, and silicone varnish.

As for the external additive, silicone-oil-treated inorganic particles, which have been treated with silicone oil, optionally with an application of heat, can be suitably used.

Examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica, and titanium dioxide are particularly preferable.

As for the silicone oil, for example, dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl or methacryl-modified silicone oil, and α-methylstyrene-modified silicone oil can be used.

An average primary particle diameter of the inorganic particles is preferably from 1 to 100 nm, and more preferably from 3 to 70 nm. When less than 1 nm, the inorganic particles are embedded into the toner particles, and therefore the inorganic particles do not effectively function. When greater than 100 nm, the inorganic particles may unevenly damage a surface of an electrostatic latent image bearer, and hence not preferable.

As the external additive, the inorganic particles, hydrophobic inorganic particles and the like may be used in combination. The average primary particle diameter of the inorganic particles is preferably from 1 to 100 nm. Of these, it is preferred that the external additive contain two types of inorganic particles having the number-average particle diameter of from 5 to 70 nm. Further, it is preferred that the external additive contain two types of inorganic particles having the number-average particle of hydrophobic-treated primary particles thereof being 20 nm or smaller, and one type of inorganic particles having the number-average particle thereof of 30 nm or greater. Moreover, the external additive preferably has BET specific surface area of from 20 to 500 $m^2/g$.

An amount of the external additive for use is preferably from 0.1 to 5% by weight, more preferably from 0.3 to 3% by weight, relative to the toner.

As the external additive, resin particles can also be added. Examples of the resin particles include; polystyrene obtained by a soap-free emulsification polymerization, suspension polymerization, or dispersion polymerization; copolymer of methacrylic ester or acrylic ester; polymer particles obtained by polymerization condensation, such as silicone, benzoguanamine, and nylon; and polymer particles formed of a thermoset resin. Use of these resin particles in combination can reinforce the charging ability of the toner, reduces reverse charges of the toner, reducing background deposition. An amount of the resin particles for use is preferably from 0.01 to 5% by weight, more preferably from 0.1 to 2% by weight, relative to the toner.

(Fluidity Improver)

A fluidity improver is an agent capable of performing surface treatment of the toner to increase hydrophobicity, and preventing degradations of flow properties and charging properties of the toner even in a high humidity environment. Examples of the fluidity improver include a silane-coupling agent, a sililation agent, a silane-coupling agent containing a fluoroalkyl group, an organic titanate-based coupling agent, an aluminum-based coupling agent, silicone oil, and modified silicone oil. The surfaces of the silica and the titanium oxide are preferably treated with the fluidity improver and used as a hydrophobic silica and a hydrophobic titanium oxide.

(Cleanability Improver)

The toner may further include a cleanability improver so as to be easily removable from a photoreceptor or a primary transfer medium when remaining thereon after image transfer. Specific examples of usable cleanability improvers include, but are not limited to, metal salts of fatty acids (e.g., zinc stearate, calcium stearate) and fine particles of polymers prepared by soap-free emulsion polymerization (e.g., polymethyl methacrylate, polystyrene). The fine particles of polymers have a narrow size distribution and a volume-average particle diameter of 0.01 to 1 μm.

(Magnetic Material)

A magnetic material is added to a toner to be magnetic when necessary.

Specific examples of the magnetic materials include, but are not limited to, iron powder, magnetite, and ferrite. Among these, a magnetic material having a whitish color is used.

Next, a method of preparing the toner of the present invention is explained.

A preferred method includes the following processes (1) to (6).

(1) Preparation of Toner Material Solution or Dispersion

A toner material solution or dispersion is prepared by dissolving or dispersing toner materials in an organic solvent.

The toner materials are not particularly limited, and can be selected according to purposes. Other than the binder resin, the toner materials may further include, for example, a second binder resin, a compound including an active hydrogen group, a modified polyester (prepolymer) reactable with the compound including an active hydrogen group, a colorant, a release agent, a charge controlling agent, etc. The organic solvent is removed during or after the process of forming toner particles.

The organic solvent may be a volatile solvent having a boiling point less than 150° C., which is easily removable. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these solvents, an ester solvent is preferably used, and ethyl acetate is more preferably used. Two or more of these solvents can be used in combination.

The used amount of the organic solvent is 40 to 300 parts by weight, 60 to 140 parts by weight, or 80 to 120 parts by weight, base on 100 parts by weight of the toner materials.

The toner materials besides the modified polyester (prepolymer) reactable with the compound including an active hydrogen group may be added to the following aqueous medium or with the toner material solution or dispersion.

(2) Preparation of Aqueous Medium

In the second step, an aqueous medium is prepared from an aqueous solvent, such as water, a water-miscible solvent, and mixtures thereof.

Specific examples of usable water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone. Two or more of these materials can be used in combination.

The aqueous medium may include a dispersant for the purpose of stabilizing liquid droplets to be formed when the toner components liquid is emulsified in the aqueous medium, to obtain toner particles with a desired shape and a narrow particle size distribution. The dispersant may be, for example, a surfactant, a poorly-water-soluble inorganic compound, or a polymeric protection colloid. Two or more of the materials can be used in combination. Among these, the surfactant is preferably used.

Usable surfactants include anionic surfactants, cationic surfactants, nonionic surfactants, and ampholytic surfactants.

Specific examples of usable anionic surfactants include, but are not limited to, alkylbenzene sulfonate, α-olefin sulfonate, phosphate, and anionic surfactants having a fluoroalkyl group.

¥ Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C 10) sulfonamide propyl trimethyl ammonium salts, perfluoroalkyl (C6-C10)-N-ethyl sulfonyl glycine salts, and monoperfluoroalkyl(C6-C16) ethyl phosphates. Specific examples of commercially available such anionic surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of usable cationic surfactants include, but are not limited to, amine salt type surfactants, quaternary ammonium salt type surfactants, and cationic surfactants having a fluoroalkyl group.

Specific examples of the amine salt type surfactants include, but are not limited to, alkylamine salts, amino alcohol fatty acid derivatives, polyamine fatty acid derivatives, and imidazoline. Specific examples of the quaternary ammonium salt type surfactants include, but are not limited to, alkyl trimethyl ammonium salt, dialkyl dimethyl ammonium salt, alkyl dimethyl benzyl ammonium salt, pyridinium salt, alkyl isoquinolinium salt, and benzethonium chloride.

Specific examples of the cationic surfactants having a fluoroalkyl group include, but are not limited to, aliphatic primary, secondary, and tertiary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts are also usable as cationic surfactants.

Specific examples of commercially available such cationic surfactants having a fluoroalkyl group include, but are not limited to, SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of usable nonionic surfactants include, but are not limited to, fatty acid amide derivatives and polyol derivatives.

Specific examples of usable ampholytic surfactants include, but are not limited to, alanine, dodecyl di(aminoethyl)glycine, di(octylaminoethyl)glycine, and N-alkyl-N,N-dimethyl ammonium betaine.

Specific examples of usable poorly-water-soluble inorganic compounds include, but are not limited to, tricalcium phosphate, calcium carbonate, titanium oxide, colloidal silica, and hydroxyapatite.

Specific examples of usable polymeric protection colloids include, but are not limited to, homopolymers and copolymers obtained from monomers, such as acid monomers, acrylate and methacrylate monomers having hydroxyl group, vinyl alcohol monomers, vinyl ether monomers, vinyl carboxylate monomers, amide monomers and methylol compounds thereof, chloride monomers, and/or monomers containing nitrogen or a nitrogen-containing heterocyclic ring; and polyoxyethylenes and celluloses.

Specific examples of the acid monomers include, but are not limited to, acrylic acid, methacrylic acid, α-cyanoacrylic acid, α-cyanomethacrylic acid, itaconic acid, crotonic acid, fumaric acid, maleic acid, and maleic anhydride.

Specific examples of the acrylate and methacrylate monomers having hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide.

Specific examples of the vinyl ether monomers include, but are not limited to, vinyl methyl ether, vinyl ethyl ether, and vinyl propyl ether. Specific examples of the vinyl carboxylate monomers include, but are not limited to, vinyl acetate, vinyl propionate, and vinyl butyrate.

Specific examples of the amide monomers include, but are not limited to, acrylamide, methacrylamide, and diacetone acrylamide.

Specific examples of the chloride monomers include, but are not limited to, acrylic acid chloride and methacrylic acid chloride.

Specific examples of the monomers containing nitrogen or a nitrogen-containing heterocyclic ring include, but are not limited to, vinyl pyridine, vinyl pyrrolidone, vinyl imidazole, and ethylene imine.

Specific examples of the polyoxyethylene resins include, but are not limited to, polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester.

Specific examples of the celluloses include, but are not limited to, methyl cellulose, hydroxyethyl cellulose, and hydroxypropyl cellulose.

A dispersion stabilizer is usable when preparing the aqueous dispersion of resin particles. Specific examples of usable dispersion stabilizers include, but are not limited to, acid-soluble or alkali-soluble compounds such as calcium phosphate.

The aqueous medium may further include a catalyst for urea or urethane reaction, such as dibutyl tin laurate or dioctyl tin laurate, when the toner components include a polyester prepolymer reactive with a compound having an active hydrogen group.

(3) Preparation of Emulsion Slurry:

In the third step, the toner material solution or dispersion is emulsified in the aqueous medium while being agitated. Specific instruments usable for the emulsification include, but are not limited to, batch emulsifiers such as HOMOGENIZER (from IKA Japan), POLYTRON® (from KINEMATICA AG), and TK AUTO HOMO MIXER® (from PRIMIX Corporation); continuous emulsifiers such as EBARA MILDER® (from Ebara Corporation), TK FILMICS® (from PRIMIX Corporation), TK PIPELINE HOMO MIXER® (from PRIMIX Corporation), colloid mill (from SHINKO PANTEC CO., LTD.), slasher, trigonal wet pulverizer (from Mitsui Miike Machinery Co., Ltd.), CAVITRON® (from Eurotec), and FINE FLOW MILL® (from Pacific Machinery & Engineering Co., Ltd.); high-pressure emulsifiers such as MICROFLUIDIZER (from Mizuho Industrial Co., Ltd.), NANOMIZER (from NANOMIZER Inc.), and APV GAULIN(SPX Corporation); film emulsifier (from REICA Co., Ltd.); vibration emulsifiers such as VIBRO MIXER (from REICA Co., Ltd.); and ultrasonic emulsifiers such as ultrasonic homogenizer (from BRANSON). In one or more embodiments, APV GAULIN, HOMOGENIZER, TK AUTO HOMO MIXER®, EBARA MILDER®, TK FILMICS®, or TK PIPELINE HOMO MIXER® is used in view of uniform particle diameter.

(4) Removal of Organic Solvent

In the fourth step, the organic solvent is removed from the emulsion slurry.

The organic solvent can be removed from the emulsion by (i) gradually heating the emulsion to completely evaporate the organic solvent from liquid droplets or (ii) spraying the emulsion into dry atmosphere to completely evaporate the organic solvent from liquid droplets. In the latter case, aqueous dispersants, if any, can also be evaporated.

(5) Washing, Drying, and Classification

After complete removal of the organic solvent from the emulsion, mother toner particles are obtained. In the fifth step, the mother toner particles are washed, dried, and optionally classified by size. Undesired fine particles are removed by cyclone separation, decantation, or centrifugal separation, for example. Alternatively, dried mother toner particles are subject to classification. In a case in which a dispersant soluble in acids and bases (e.g., calcium phosphate) is used, the resultant mother particles may be first washed with an acid (e.g., hydrochloric acid) and then washed with water to remove the dispersant.

(6) External Addition of Inorganic Fine Particles In the sixth step, the dried toner particles are optionally mixed with fine particles of inorganic materials, such as silica and titanium oxide, and/or charge controlling agents, followed by application of mechanical impulsive force, so that release agent particles are prevented from releasing from the surfaces of the mother toner particles.

Mechanical impulsive force can be applied to the mother toner particles by agitating the mother toner particles with blades rotating at a high speed, or accelerating the mother toner particles in a high-speed airflow so that the toner particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

The toner of the present invention is not limited in its properties, such as shape and size. The toner preferably has the following properties in terms of volume-average particle diameter (Dv), number-average particle diameter (Dn), penetration, low-temperature fixability, and offset resistance.

The toner preferably has a volume-average particle diameter (Dv) of from 3 to 8 μm. When less than 3 μm, such toner particles may undesirably fuse on the surfaces of carrier particles and degrade charging ability of the carrier particles after a long-term agitation in a developing device, when used for a two-component developer. Such toner particles may also fuse on a developing roller or a toner layer regulator, when used for a one-component developer. When greater than 8 μm, such toner particles may be difficult to produce high-resolution and high-quality images. Moreover, the average particle diameter may largely vary upon consumption and supply of such toner particles used for a developer.

A ratio (Dv/Dn) of the volume-average particle diameter (Dv) to the number-average particle diameter (Dn) is preferably from 1.00 to 1.25. When less than 1.00, such toner particles may undesirably fuse on the surfaces of carrier particles and degrade charging ability of the carrier particles and cleanability of toner particles after a long-term agitation in a developing device, when used for a two-component developer. Such toner particles may also fuse on a developing roller or a toner layer regulator, when used for a one-component developer. When greater than 1.30, it may be difficult to produce high-resolution and high-quality images. Moreover, the average particle diameter of such toner particles in a developer may largely vary upon consumption and supply of the toner particles.

When Dv/Dn is 1.00 to 1.25, the toner has a good combination of storgeability, low-temperature fixability, hot offset resistance, and gloss property. When such a toner is used for a two-component developer, the average toner size may not vary very much although consumption and supply of toner particles are repeated. When such a toner is used for a one-component developer, the average toner size may not vary very much although consumption and supply of toner particles are repeated. Additionally, the toner may not adhere or fix to a developing roller or a toner layer regulating blade. Thus, stable developability is provided for an extended period of time.

The volume-average particle diameter (Dv) and the number-average particle diameter (Dn) of the toner can be measured by a particle size analyzer MULTISIZER II (from Beckman Coulter, Inc.).

The toner preferably has a penetration not less than 15 mm, and more preferably from 20 to 25 mm when measured by a penetration test based on JIS K2235-1991. When less than 15 mm, thermostable storageability of the toner may be poor.

The penetration is measured based on a method according to JIS K-2235-1991 as follows. First, fill a 50-ml glass vial with a toner and leave the vial in a constant-temperature chamber at 50° C. for 20 hours. Cool the vial to room temperature and subject the toner to the penetration test. Penetration (mm) represents how deep the needle penetrates the toner in the vial. The greater the penetration, the better the thermostable storageability of the toner.

The toner of the present invention preferably has a low minimum fixable temperature and a high temperature at which offset does not occur in terms of having both low-temperature fixability and offset resistance. Therefore, it is preferable that the minimum fixable temperature is preferably less than 150° C. and the temperature at which the offset does not occur is not less than 200° C. The minimum fixable temperature is a temperature of a fixing roller in an image forming apparatus producing images having an image density not less than 70% after scraped with a pad. The temperature at which the offset does not occur can be measured using an image forming apparatus wherein each yellow, magenta, cyan, black, red, blue and green single color solid image can be developed and a fixer can have a variable temperature.

A color of the toner of the present invention is not particularly limited, and can be selected according to purposes and from one of black, cyan, magenta and yellow. The color can be obtained by selecting colorants.

The toner of the present invention preferably has an acid value of from 1.0 to 50.0 mgKOH/g, and more preferably from 3 to 35 mgKOH/g to be negatively charged.

(Developer)

A developer includes the toner of the present invention and other components such as a carrier. The developer may be either a one-component developer or a two-component developer. The two-component developer is compatible with high-speed printers, in accordance with recent improvement in information processing speed, owing to its long lifespan.

The average toner size may not vary very much although consumption and supply of toner particles are repeated. Additionally, toner particles may not adhere or fix to a developing roller or a toner layer regulating blade. Thus, the one-component developer reliably provides stable developability and image quality for an extended period of time.

In the two-component developer according to an embodiment, the average toner size may not vary very much although consumption and supply of toner particles are repeated. Thus, the two-component developer reliably provides stable developability for an extended period of time. The two-component developer preferably includes a carrier in an amount of from 90 to 98% by weight, and more preferably from 93 to 97% by weight. The carrier may comprise a core material and a resin layer that covers the core material. Specific examples of usable core materials include, but are not limited to, manganese-strontium (Mn—Sr) and manganese-magnesium (Mn—Mg) materials having a magnetization of 50 to 90 emu/g. High magnetization materials such as iron powders having a magnetization of 100 emu/g or more and magnetites having a magnetization of from 75 to 120 emu/g are suitable for improving image density. Additionally, low magnetization materials such as copper-zinc (Cu—Zn) materials having a magnetization of from 30 to 80 emu/g are suitable for producing a high-quality image, because carriers made of such materials can weakly contact a photoreceptor. Two or more of these materials can be used in combination.

The core material preferably has a volume-average particle diameter of from 10 to 150 μm, and more preferably from 20 to 80 μm. When the volume-average particle diameter is less than 10 μm, it means that the resultant carrier particles include a relatively large amount of fine particles, and therefore the magnetization per carrier particle is too low to prevent carrier particles scattering. When the volume-average particle diameter is greater than 150 μm, it means that the specific surface area of the carrier particle is too small to prevent toner particles from scattering. Therefore, solid portions in full-color images may not be reliably reproduced.

Specific examples of usable resins for the resin layer include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidene fluoride-acrylic monomer copolymer, vinylidene fluoride-vinyl fluoride copolymer, tetrafluoroethylene-vinylidene fluoride-non-fluoride monomer terpolymer, and silicone resins. Two or more of these resins can be used in combination. Among these, silicone resins are preferably used.

Specific examples of usable amino resins include, but are not limited to, urea-formaldehyde resin, melamine resin, benzoguanamine resin, urea resin, polyamide resin, epoxy resin. Specific examples of usable polyvinyl resins include, but are not limited to, acrylic resin, polymethyl methacrylate resin, polyacrylonitrile resin, polyvinyl acetate resin, polyvinyl alcohol resin, and polyvinyl butyral resin. Specific examples of usable polystyrene resins include, but are not limited to, polystyrene and styrene-acrylic copolymer. Specific examples of the halogenated olefin resins include, but are not limited to, polyvinyl chloride. Specific examples of the polyester resins include, but are not limited to, polyethylene terephthalate and polybutylene terephthalate.

The resin layer may include a conductive powder such as metal, carbon black, titanium oxide, tin oxide, and zinc oxide. In some embodiments, the conductive powder has a volume average particle diameter of 1 μm or less. When the volume average particle diameter is greater than 1 μm, it may be difficult to control electric resistivity of the resin layer.

The resin layer can be formed by, for example, dissolving a resin (e.g., a silicone resin) in an organic solvent to prepare a coating liquid, and uniformly applying the coating liquid on the surface of the core material, followed by drying and baking. The coating method may be, for example, dip coating, spray coating, or brush coating.

Specific examples of usable organic solvents include, but are not limited to, toluene, xylene, methyl ethyl ketone, methyl isobutyl ketone, cellosolve, and butyl acetate.

The baking method may be either an external heating method or an internal heating method that uses a stationary electric furnace, a fluid electric furnace, a rotary electric furnace, a burner furnace, or microwave.

The content of the resin layer in the carrier is 0.01 to 5.0% by weight. When the content of the resin layer is less than 0.01% by weight, it means that the resin layer cannot be uniformly formed on the core material. When the content of the resin layer is greater than 5.0% by weight, it means that the resin layer is so thick that each carrier particles are fused with each other.

The toner container of the present invention includes the developer of the present invention.

The container is not particularly limited and can be selected from known containers, and containers having a cap are preferably used. The container may have a size, a shape, a structure, a material, etc. in accordance with the purposes. The container preferably has a cylindrical shape and spiral concavities and convexities on the inner circumferential face, and a part or all of which are accordion. Such a container transfers a toner therein to a discharge outlet thereof when rotated. The container is preferably formed of a material having good size preciseness, such as a polyester resin, polyethylene, polypropylene, polystyrene, polyvinylchloride, polyacrylate, a polycarbonate resin, an ABS resin and polyacetal resin.

<Image Forming Method and Image Forming Apparatus>

The image forming method of the present invention includes at least an electrostatic latent image forming process, a developing process, a transfer process, and a fixing process. The image forming method may optionally include other processes such as a neutralization process, a cleaning process, a recycle process, and a control process, if needed.

The image forming apparatus of the present invention includes at least an electrostatic latent image bearing member, an electrostatic latent image forming device, a developing device, a transfer device, and a fixing device. The image forming apparatus may optionally include other members, such as a neutralizer, a cleaner, a recycler, and a controller, if needed.

—The Electrostatic Latent Image Forming Process and the Electrostatic Latent Image Forming Device—

The electrostatic latent image forming process is a process which forms an electrostatic latent image on an electrostatic latent image bearing member. The electrostatic latent image bearing member (hereinafter may be referred to as "electrophotographic photoreceptor" or "photoreceptor") is not limited in material, shape, structure, and size. In some embodiments, the electrostatic latent image bearing member has a drum-like shape and is comprised of an inorganic photoconductor, such as amorphous silicone or selenium, or an organic photoconductor, such as polysilane or phthalopolymethine. Amorphous silicone is advantageous in terms of long lifespan.

In the electrostatic latent image forming process, an electrostatic latent image forming device uniformly charges a surface of the electrostatic latent image bearing member and irradiates the charged surface with light containing image information. The electrostatic latent image forming device comprises a charger for uniformly charging a surface of the electrostatic latent image bearing member and an irradiator for irradiating the charged surface with light containing image information.

The charger is adapted to charge a surface of the electrostatic latent image bearing member by supplying a voltage thereto. The charger may be, for example, a contact charger equipped with a conductive or semiconductive roll, brush, film, or rubber blade, or a non-contact charger such as corotron and scorotron that use corona discharge.

The charger is disposed in contact or non-contact with the electrostatic latent image bearing member so as to supply an AC-DC superimposed voltage to a surface of the electrostatic latent image bearing member. The charger is preferably a non-contact charging roller disposed proximal to the electrostatic latent image bearing member, adapted to supply an AC-DC superimposed voltage to a surface of the electrostatic latent image bearing member.

The irradiator is adapted to irradiate the charged surface of the electrostatic latent image bearing member with light containing image information. The irradiator may be, for example, a radiation optical type, a rod lens array type, a laser optical type, or a liquid crystal shutter optical type.

The electrostatic latent image bearing member may be irradiated with light from the reverse surface (back surface) side thereof.

—Developing Process and Developing Device—

The developing process is a process which develops the electrostatic latent image into a toner image that is visible with the toner or developer according to an embodiment. The developing device is adapted to develop the electrostatic latent image into a toner image with the toner or developer according to an embodiment. In some embodiments, the developing device includes a developing unit adapted to store and supply the toner or developer to the electrostatic latent image with or without contacting the electrostatic latent image.

The developing device may employ either a dry developing method or a wet developing method. The developing device may be either a single-color developing device or a multicolor developing device. The developing device may be comprised of an agitator for frictionally agitating and charging the developer and a rotatable magnet roller.

Toner particles and carrier particles are mixed and agitated within the developing device so that the toner particles are frictionally charged. The charged toner particles and carrier particles are borne on the surface of the magnet roller forming chainlike aggregations (hereinafter "magnetic brush"). The magnet roller is disposed adjacent to the electrostatic latent image bearing member. Therefore, a part of the toner particles in the magnetic brush migrates from the surface of the magnet roller to the surface of the electrostatic latent image bearing member due to electrical attractive force. As a result, the electrostatic latent image formed on the electrostatic latent image bearing member is developed into a toner image.

—Transfer Process and Transfer Device—

The transfer process is a process that transfers the toner image onto a recording medium. In some embodiments, the toner image is primarily transferred onto an intermediate transfer medium and secondarily transferred onto the recording medium.

Plural toner images with different colors are primarily transferred onto the intermediate transfer medium to form a composite toner image and the composite toner image is secondarily transferred onto the recording medium. The toner image may be transferred from the electrostatic latent image bearing member upon charging of the electrostatic latent image bearing member by a transfer charger.

The transfer device includes plural primary transfer devices each adapted to transfer a toner image onto the intermediate transfer medium to form a composite toner image, and a secondary transfer device adapted to transfer the composite toner image onto the recording medium.

The intermediate transfer medium may be, for example, a transfer belt.

Each transfer device (including the primary transfer device and the secondary transfer device) contains a transfer unit adapted to separate a toner image from the electrostatic latent image bearing member toward a recording medium side.

The number of transfer devices is not limited, i.e., one or more. The transfer unit may be, for example, a corona discharger, a transfer belt, a transfer roller, a pressure transfer roller, or an adhesive transfer unit. The recording medium is not limited to a specific material, and any kind of material can be used as the recording medium.

—Fixing Process and Fixing Device—

The fixing process is a process which fixes the toner image on a recording medium. Each single-color toner image may be independently fixed on a recording medium, or alternatively, a composite toner image including a plurality of color toner images may be fixed on a recording medium at once.

The fixing device includes fixing members adapted to fix a toner image by application of heat and pressure. For example, the fixing device may include a combination of a heating roller and a pressing roller, or a combination of a heating roller, a pressing roller, and an endless belt. In some embodiments, the fixing device includes a heater equipped with a heating element, a film in contact with the heater, and a pressing member pressed against the heater with the film therebetween. Such a fixing device is adapted to pass a recording medium having a toner image thereon between the film and the pressing member so that the toner image is fixed on the recording medium upon application of heat and pressure. In some embodiments, the heating member is heated to a temperature of 80 to 200° C. In the fixing process, an optical fixer can be used in place of or in combination with the fixing device.

—Neutralization Process and Neutralizer—

The neutralization process is a process in which the neutralizer neutralizes the electrostatic latent image bearing member by supplying a neutralization bias thereto. The neutralizer may be, for example, a neutralization lamp.

—Cleaning Process and Cleaner—

The cleaning process is a process in which the cleaner removes residual toner particles remaining on the electrostatic latent image bearing member. The cleaner may be, for example, a magnetic brush cleaner, an electrostatic brush cleaner, a magnetic roller cleaner, a blade cleaner, a brush cleaner, or a web cleaner.

—Recycle Process and Recycler—

The recycle process is a process in which the recycler supplies the residual toner particles collected in the cleaning process to the developing device. The recycler may be, for example, a conveyer.

—Control Process and Controller—

The control process is a process in which the controller controls the above-described processes. The controller may be, for example, a sequencer or a computer.

Figure 2:
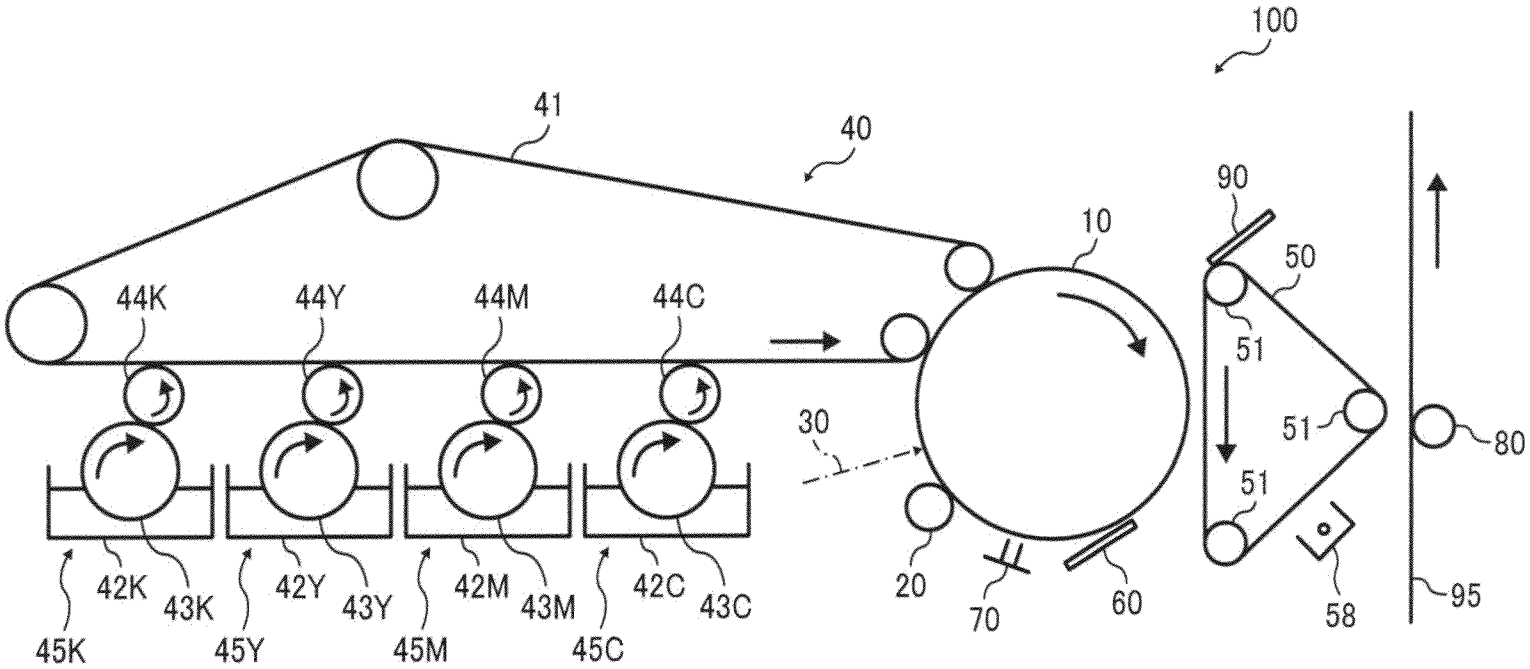
FIG. 2 is a schematic view illustrating an embodiment of the image forming apparatus of the present invention.

FIG. 2 is a schematic view illustrating an embodiment of the image forming apparatus of the present invention An image forming apparatus 100 includes a photoreceptor drum 10 serving as the electrostatic latent image bearing member, a charging roller 20, an irradiator 30, a developing device 45, an intermediate transfer medium 50, a cleaning device 60, and a neutralization lamp 70.

Figure 3:
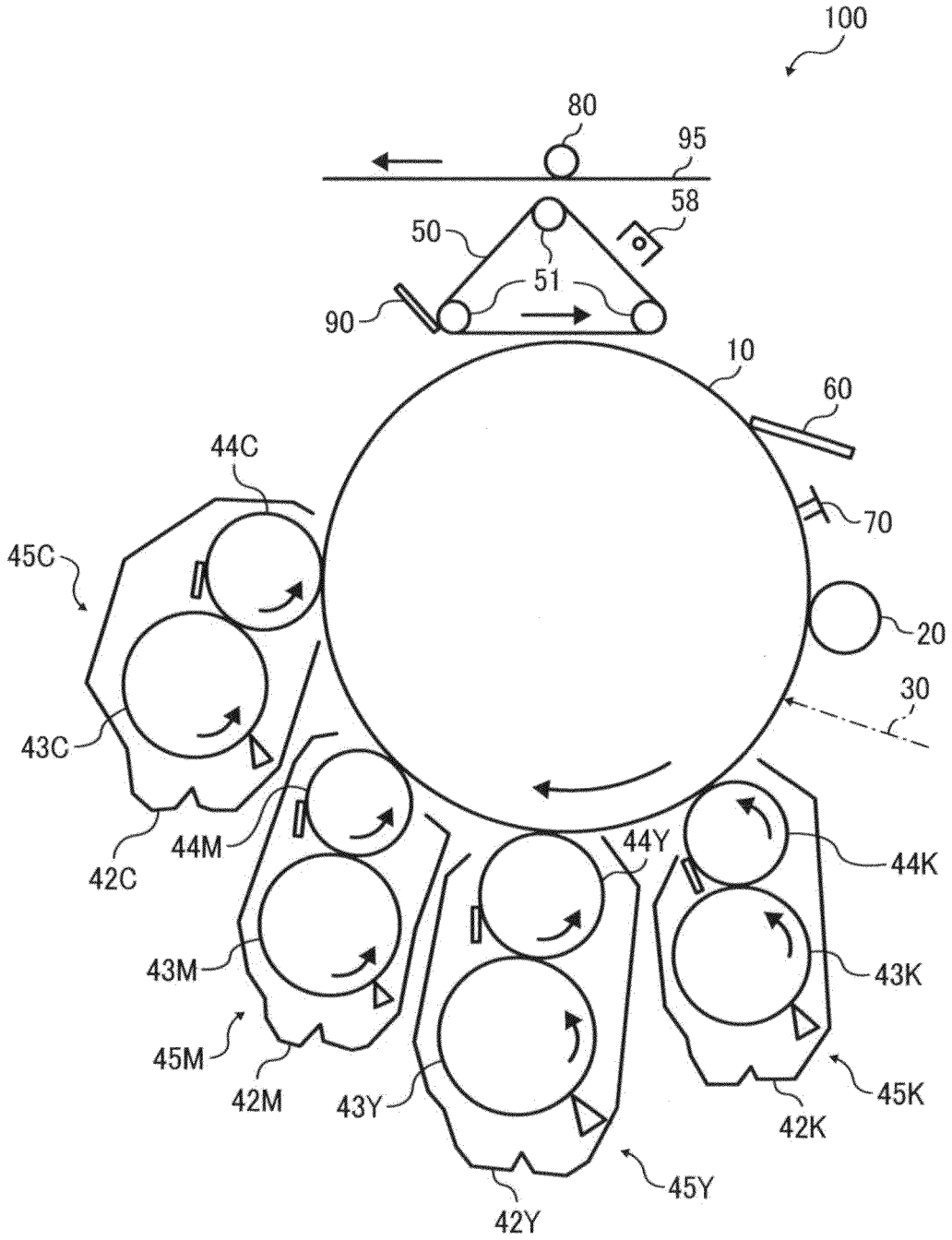
FIG. 3 is a schematic view illustrating another embodiment of the image forming apparatus of the present invention.

An intermediate transfer medium 50 is a seamless belt stretched taut with three rollers 51 and is movable in a direction indicated by arrow in FIG. 3. One of the three rollers 51 is adapted to supply a primary transfer bias to the intermediate transfer medium 50. A cleaner 90 is disposed adjacent to the intermediate transfer medium 50. A transfer roller 80 is disposed facing the intermediate transfer medium 50. The transfer roller 80 is adapted to supply a secondary transfer bias for transferring a toner image onto a recording medium 95.

A corona charger 58 is disposed facing the intermediate transfer medium 50 between the contact points of the intermediate transfer medium 50 with the photoreceptor drum 10 and the recording medium 95 with respect to the direction of rotation of the intermediate transfer medium 50. The corona charger 58 is adapted to give charge to the toner image on the intermediate transfer medium 50.

The developing device 40 includes a developing belt 41 and a black developing unit 45K, an yellow developing unit 45Y, a magenta developing unit 45M, and a cyan developing unit 45C around the belt. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C.

The developing belt 41 is an endless belt and rotatably extended and suspended by plural belt rollers, partially contacting a photoreceptor 10.

In the image forming apparatus 100 in FIG. 2, the charging roller 20 uniformly charges the photoreceptor 10. The irradiator 30 irradiates the photoreceptor 10 with light containing image information to form an electrostatic latent image thereon. The developing device 45 supplies toner to the electrostatic latent image formed on the photoreceptor 10 to form a toner image. The toner image is primarily transferred onto the intermediate transfer medium 50 by a voltage supplied from the roller 51 and is secondarily transferred onto the recording medium 95. Residual toner particles remaining on the photoreceptor 10 are removed by the cleaning device 60. The photoreceptor 10 is neutralized by the neutralization lamp 70.

FIG. 3 is a schematic view illustrating another embodiment of the image forming apparatus of the present invention.

An image forming apparatus 100 has the same configuration as that of the image forming apparatus 100 in FIG. except for not having the developing belt 41 and that a black developing unit 45K, an yellow developing unit 45Y, a magenta developing unit 45M, and a cyan developing unit 45C are located around a photoreceptor 10, directly facing the photoreceptor 10. Components in FIG. 3, which are the same as those in FIG. 2 have the same numerals as those therein.

Figure 4:
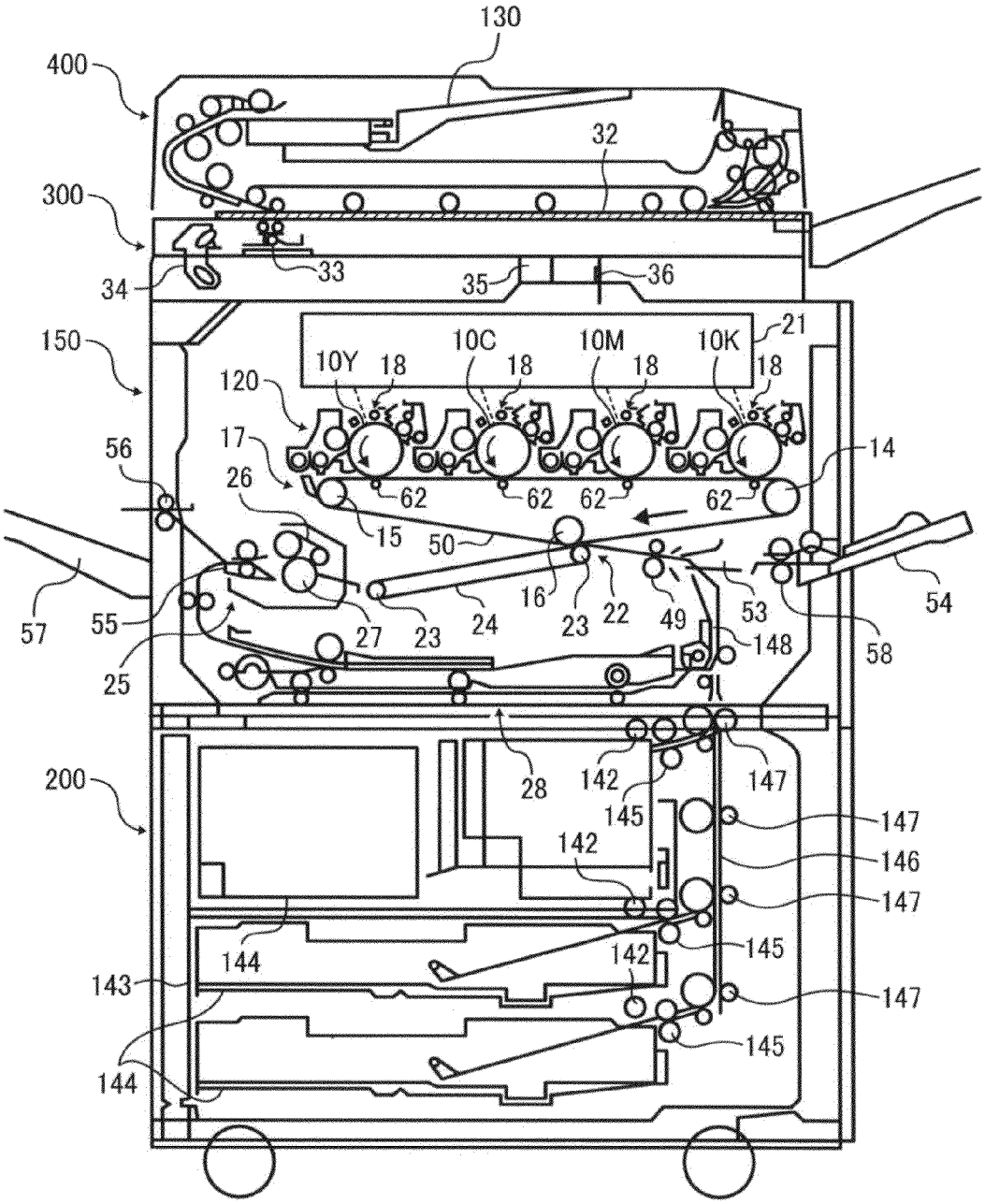
FIG. 4 is a schematic view illustrating a further embodiment of the image forming apparatus of the present invention.

FIG. 4 is a schematic view of an image forming apparatus according to another embodiment. An image forming apparatus illustrated in FIG. 4 is a tandem-type full-color image forming apparatus including a main body 150, a paper feed table 200, a scanner 300, and an automatic document feeder (ADF) 400. A seamless-belt intermediate transfer medium 50 is disposed at the center of the main body 150. The intermediate transfer medium 50 is stretched taut with support rollers 14, 15, and 16 and is rotatable clockwise in FIG. 4. A cleaner 17 is disposed adjacent to the support roller 15. The cleaner 17 is adapted to remove residual toner particles remaining on the intermediate transfer medium 50. Four image forming units 18Y, 18C, 18M, and 18K (hereinafter collectively the "image forming units 18") adapted to form respective toner images of yellow, cyan, magenta, and cyan are disposed in tandem facing a surface of the intermediate transfer medium 50 stretched between the support rollers 14 and 15. The image forming units 18 form a tandem developing device 120.

An irradiator 21 is disposed adjacent to the tandem developing device 120. A secondary transfer device 22 is disposed on the opposite side of the tandem developing device 120 with respect to the intermediate transfer medium 50. The secondary transfer device 22 includes a seamless secondary transfer belt 24 stretched taut with a pair of rollers 23. A recording medium conveyed by the secondary transfer belt 24 is brought into contact with the intermediate transfer medium 50. A fixing device 25 is disposed adjacent to the secondary transfer device 22. The fixing device 25 includes a seamless fixing belt 26 and a pressing roller 27 pressed against the fixing belt 26. A sheet reversing device 28 adapted to reverse a sheet of recording medium in duplexing is disposed adjacent to the secondary transfer device 22 and the fixing device 25.

In the tandem developing device 120, a full-color image is produced in the manner described below.

A document is set on a document table 130 of the automatic document feeder 400. Alternatively, a document is set on a contact glass 32 of a scanner 300 while lifting up the automatic document feeder 400, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light to the document and reflects a light reflected from the document toward the second runner 34.

The second runner 34 then reflects the light toward a reading sensor 36 through an imaging lens 35. Thus, image information of black, magenta, cyan, and yellow is read.

The image information of yellow, cyan, magenta, and black are respectively transmitted to the image forming units 18Y, 18C, 18M, and 18K. The image forming units 18Y, 18C, 18M, and 18K form respective toner images of yellow, cyan, magenta, and black.

Figure 5:
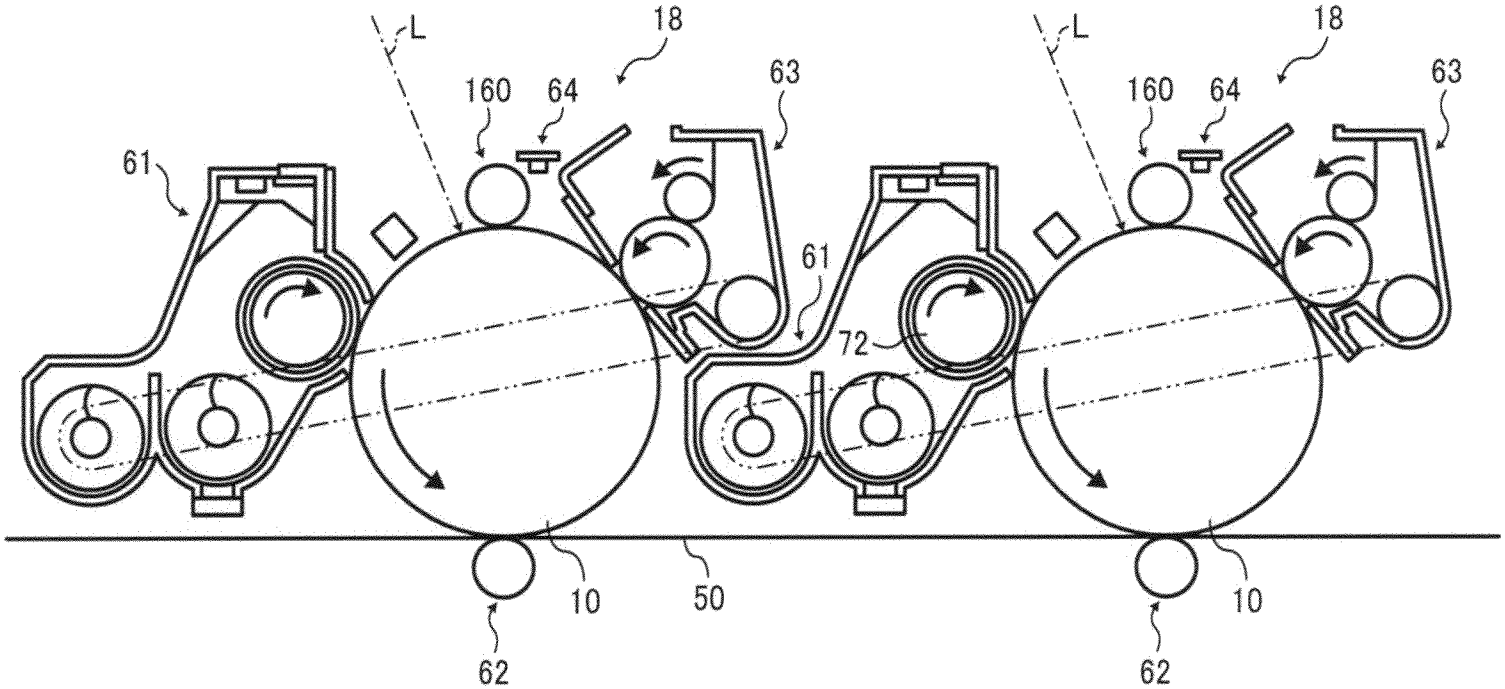
FIG. 5 is a schematic view illustrating more details of a part of the image forming apparatus in FIG. 3.

As illustrated in FIG. 5, each of the image forming units 18 includes a photoreceptor 10, a charger 160 adapted to uniformly charge the photoreceptor 10, an irradiator adapted to irradiate the charged surface of the photoreceptor 10 with light L containing image information to form an electrostatic latent image, a developing device 61 adapted to develop the electrostatic latent image into a toner image, a transfer charger 62 adapted to transfer the toner image onto the intermediate transfer medium 50, a cleaner 63, and a neutralization lamp 64. The toner images of yellow, cyan, magenta, and black are sequentially transferred from the respective photoreceptors 10Y, 10M, 10C, and 10K onto the intermediate transfer medium 50 that is endlessly moving.

Thus, the toner images of yellow, cyan, magenta, and black are superimposed on one another on the intermediate transfer medium 50, thus forming a composite full-color toner image.

On the other hand, upon pressing of the switch, one of paper feed rollers 142 starts rotating in the paper feed table 200 so that a sheet of a recording medium is fed from one of paper feed cassettes 144 in a paper bank 143. The sheet is separated by one of separation rollers 145 and fed to a paper feed path 146. Feed rollers 147 feed the sheet to a paper feed path 148 in the main body 150. The sheet is then stopped by a registration roller 49. Alternatively, a recording medium may be fed from a manual feed tray 54. In this case, a separation roller 58 separates a sheet of the recording medium and feeds it to a manual paper feed path 53. The sheet is then stopped by the registration roller 49. Although the registration roller 49 is generally grounded, the registration roller 49 can be supplied with a bias for the purpose of removing paper powders from the sheet.

The registration roller 49 feeds the sheet to the gap between the intermediate transfer medium 50 and the secondary transfer belt 24 in synchronization with an entry of the composite full-color toner image formed on the intermediate transfer medium 50 into the gap. Thus, the composite full-color toner image is transferred onto the sheet. After the composite toner image is transferred, residual toner particles remaining on the intermediate transfer medium 50 are removed by the cleaner 17.

The sheet having the composite toner image thereon is fed from the secondary transfer device 22 to the fixing device 25. The fixing device 25 fixes the composite toner image on the sheet by application of heat and/or pressure.

The sheet is then discharged by a discharge roller 56 to be stacked on the discharge tray 57. Alternatively, the switch claw 55 switches paper feed paths so that the sheet gets reversed in the sheet reversing device 28. After forming another toner image on the back side of the sheet, the sheet is discharged onto the discharge tray 57 by rotation of a discharge roller 56.

A process cartridge according to an embodiment includes at least an electrostatic latent image bearing member adapted to bear an electrostatic latent image and a developing device adapted to develop the electrostatic latent image into a toner image with the toner according to an embodiment. The process cartridge is detachably attachable to image forming apparatuses.

The developing device includes at least a developer container for containing the developer according to an embodiment and a developer bearing member adapted to bear and convey the developer in the developer container. The developing device may further include a toner layer regulator adapted to regulate the thickness of a toner layer on the developer bearing member.

Figure 6:
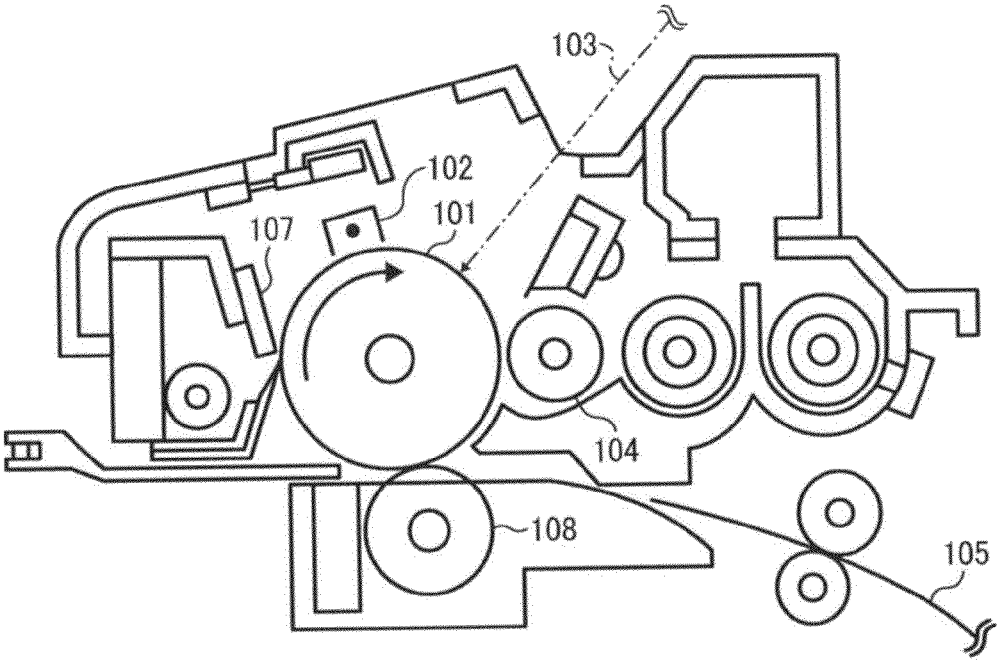
FIG. 6 is a schematic view illustrating an embodiment of the process cartridge of the present invention.

FIG. 6 is a schematic view of a process cartridge according to an embodiment. The process cartridge includes an electrostatic latent image bearing member 101, a charger 102, a developing device 104, a transfer device 108, and a cleaner 107. In FIG. 6, a numeral 103 denotes a light beam emitted from an irradiator and a numeral 105 denotes a recording medium.

The electrostatic latent image bearing member 101 is charged by the charger 102 and then exposed to the light beam 103 emitted from the irradiator while rotating clockwise in FIG. 6. As a result, an electrostatic latent image is formed on the electrostatic latent image bearing member 101. The developing device 104 develops the electrostatic latent image into a toner image. The transfer device 108 transfers the toner image onto the recording medium 105. The cleaner 107 cleans the surface of the electrostatic latent image bearing member 101 after the toner image is transferred therefrom and a neutralizer further neutralizes the surface. The above-described procedures are repeated.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

(Measurement of Molecular Weight)

Instrument: GPC (from Tosoh Corporation)

Detector: R1

Measurement temperature: 40° C.

Mobile phase: Tetrahydrofuran

Flow rate: 0.45 mL/min

Number average molecular weight (Mn) and weight average molecular weight (Mw) are determined by GPC (gel permeation chromatography) with reference to a calibration curve complied from polystyrene standard samples having known molecular weights.

(Measurement of Glass Transition Temperature (Tg))

Instrument: DSC (Q2000 from TA Instruments)

An aluminum simplified sealed pan is filled with 5 to 10 mg of a sample and is subjected to the following procedures.

1st heating: Heat from 3 to 220° C. at a heating rate of 5° C./min and keep at 220° C. for 1 minute.

Cooling: Quench to −60° C. without temperature control and keep at −60° C. for 1 minute.

2nd Heating: Heat from −60 to 180° C. at a heating rate of 5° C./min.

Glass transition temperature is determined from the midpoint observed in the thermogram obtained in the 2nd heating based on a method according to ASTM D3418/82. As to the first binder resin, a glass transition temperature observed in a lower temperature side is determined as Tg1 and that observed in a higher temperature side is determined as Tg2.

(Measurement of Average Domain Size)

Instrument: AFM (MFP-3D from Asylum Technology Co., Ltd.)

Cantilever: OMCL-AC240TS-C3

Target amplitude: 0.5 V

Target percent: −5%

Amplitude set point: 315 mV

Scan rate: 1 Hz

Scan points: 256×256

Scan angle: 0°

A block of each sample (i.e., resin) is cut into an ultrathin section with an ultra microtome ULTRACUT (from Leica) under the following conditions. The ultrathin section is subjected to an observation with the AFM.

Cutting thickness: 60 nm

Cutting speed: 0.4 mm/sec

Cutting instrument: Diamond knife (Ultra Sonic 35°)

Thirty (30) dispersion diameters of high phase image difference of the obtained AFM phase image, i.e., soft and low Tg unit were randomly selected, and an average of the longest diameter of straight line of the high phase image difference was determined as an average domain size.

Preparation Example 1

Synthesis Example of Binder Resin 1

(Synthesis of Polyester Initiator 1)

In a 300-ml reaction vessel equipped with a condenser tube, a stirrer, and a nitrogen inlet pipe, 250 g of a mixture of alcohol and acid constituents in a ratio described in Table 1 is contained. Titanium tetraisopropoxide in an amount of 1,000 ppm based on the resin constituents is also contained in the reaction vessel. The mixture is heated to 200° C. over a period of 4 hours, further heated to 230° C. over a period of 2 hours, and subjected to a reaction until no efflux is observed. The mixture is further subjected to a reaction for 5 hours under reduced pressures of 10 to 15 mmHg. Thus, a polyester initiator (1) is obtained.

Number-average molecular weight (Mn) and glass transition temperature (Tg) of the polyester initiator (1) are shown in Table 1

(Synthesis of Binder Resin 1)

In an autoclave reaction vessel equipped with a thermometer and a stirrer, a mixture of the polyester initiator (1), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a binder resin 1 is prepared. Molecular weights and glass transition temperatures of the resin 1 are shown in Table 2.

Preparation Example 2

Synthesis Example of Binder Resin 2

(Synthesis of Polyester Initiator 2)

The procedure for preparing the binder resin 1 is repeated except for changing the ratio of the polyester initiator (1) as described in Table 2. Thus, a binder resin 2 is prepared. Molecular weight and glass transition temperature of the binder resin 2 are shown in Table 2.

TABLE 1

| Polyester | Alcohol constituents (mol %) | | Acid constituents (mol %) | | | OH/ | Produced Polyester Initiator | |
|---|---|---|---|---|---|---|---|---|
| initiator No. | 3-Methyl-1,5-pentanediol | 1,3-Propanediol | Dimethyl adipate | Dimethyl terephthalate | Trimellitic anhydride | COOH (by mol) | Tg (° C.) | Mn |
| 1 | 100 | | 17 | 80 | 3 | 1.3 | −24 | 2700 |
| 2 | 100 | | 80 | 17 | 3 | 1.2 | −24 | 2700 |

TABLE 2

| | Initiator | Initiator Ratio (%) | L-Lactide Ratio (%) | D-Lactide Ratio (%) | Binder Resin Tg | Binder Resin Mn |
|---|---|---|---|---|---|---|
| Binder Resin 1 | Polyester initiator 1 | 20 | 68 | 12 | −7 | 18000 |
| Binder Resin 2 | Polyester initiator 2 | 25 | 63.7 | 11.3 | −6 | 14000 |

[Calculation of Tg−[TgA×MA/(MA+MB)+TgB×MB/(MA+MB)]]

Tg−[TgA×MA/(MA+MB)+TgB×MB/(MA+MB)] is determined in which MA is total ratio of L-Lactide and D-Lactide, TgB is a Tg of the initiator and MB is a used amount of the initiator. TgA is a Tg of the binder resin 2. In the binder resin 1, the initiator has quite low weight ratio and molecular weight, and the binder resin 1 is almost a pure polylactic resin. This is because binder resin 1 approaches a Tg of a polylactic unit in other binder resins when having the same L/D ratio. The results are shown in Table 4.

Preparation Example 3

Preparation of Master Batch

First, 1,000 parts of water, 530 parts of a carbon black (PRINTEX 35 from Degussa) having a DBP oil absorption of 42 ml/100 g and a pH of 9.5, and 1,200 parts of the resin are mixed using a HENSCHEL MIXER (from Mitsui Mining and Smelting Co., Ltd.).

The resultant mixture is kneaded for 30 minutes at 150° C. using double rolls, the kneaded mixture is then rolled and cooled, and the rolled mixture is then pulverized into particles using a pulverizer (from Hosokawa Micron Corporation). Thus, a master batch is prepared.

[Preparation of Crystalline Polyester Resin Solution]

Preparation Example 4

Preparation of Crystalline Polyester C1

In a reaction vessel including a cooling pipe, a stirrer and a nitrogen inlet tube, 159 parts of sebacic acid, 11 parts of adipic acid, 108 parts of 1,4-butanediol and 0.5 parts of titaniumdihydroxybis(triethanolaminate) as a condensation catalyst are reacted for 8 hrs under a nitrogen stream at 180° C. while produced water is removed.

Next, the reactant is reacted for 4 hrs while gradually heated to have a temperature of 225° C. under a nitrogen stream and produced water and 1,4-butanediol are removed. The reactant is further reacted under reduced pressure by 5 to 20 mm Hg until the reactant has a weight-average molecular weight about 2,500.

The resultant resin is cooled to have room temperature and pulverized to prepare a [crystalline polyester 1] having a melting point of 52° C., a Mn of 1,000 and a hydroxyl value of 27.

Preparation Example 5

Preparation of Crystalline Polyester C2

In a reaction vessel including a cooling pipe, a stirrer and a nitrogen inlet tube, 286 parts of dodecanedionic acid, 190 parts of 1,6-hexanediol and 1 part of titaniumdihydroxybis (triethanolaminate) as a condensation catalyst are reacted for 8 hrs under a nitrogen stream at 180° C. while produced water is removed.

Next, the reactant is reacted for 4 hrs while gradually heated to have a temperature of 220° C. under a nitrogen stream and produced water and 1,4-butanediol are removed. The reactant is further reacted under reduced pressure by 5 to 20 mm Hg until the reactant has a weight-average molecular weight about 3,000.

The resultant resin is cooled to have room temperature and pulverized to prepare a [crystalline polyester 2] having a melting point of 63° C., a Mn of 1,200 and a hydroxyl value of 32.

TABLE 3

| Crystalline Polyester | Melting point (° C.) | Mn | Mw | Hydroxyl value |
|---|---|---|---|---|
| C1 | 52 | 1000 | 2600 | 27 |
| C2 | 63 | 1200 | 3200 | 32 |

Example 1

Preparation of Toner 1

(Aqueous Medium 1)

An aqueous medium 1 is prepared by uniformly mixing and agitating 300 parts of ion-exchange water, 300 parts of the resin particle dispersion, and 0.2 parts of sodium dodecylbenzenesulfonate.

(Preparation of Toner)

A resin solution 1 is prepared by mixing 100 parts of the resin 1 with 100 parts of ethyl acetate in a reaction vessel.

A carnauba wax (having a molecular weight of 1,800, an acid value of 2.7 mgKOH/g, and a penetration of 1.7 mm (at 40° C.)) in an amount of 5 parts and the master batch in an amount of 5 parts are dispersed in the resin solution 1 by a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation is repeated 3 times (3 passes). Thus, a toner constituents liquid 1 is prepared.

In a vessel, 150 parts of the aqueous medium are mixed with 100 parts of the toner constituents liquid and 2.5 parts of the crystalline polyester 1 for 10 minutes by a TK HOMOMIXER (from PRIMIX Corporation) at a revolution of 12,000 rpm. Thus, an emulsion slurry b is prepared.

A flask equipped with a stirrer and a thermometer is charged with 100 parts of the emulsion slurry b. The emulsion slurry is agitated for 10 hours at 30° C. at a peripheral speed of 20 m/min so that the solvents are removed therefrom. Thus, a dispersion slurry b is prepared.

Next, 100 parts of the dispersion slurry b is filtered under reduced pressures to obtain a wet cake (i). The wet cake (i) is then mixed with 100 parts of ion-exchange water by a TK HOMOMIXER for 10 minutes at a revolution of 12,000 rpm, followed by filtration, thus obtaining a wet cake (ii).

The wet cake (ii) is mixed with 300 parts of ion-exchange water by a TK HOMOMIXER for 10 minutes at a revolution of 12,000 rpm, followed by filtration. This operation is repeated twice, thus obtaining a wet cake (iii). The wet cake (iii) is mixed with 20 parts of a 10% aqueous solution of sodium hydroxide by a TK HOMOMIXER for 30 minutes at a revolution of 12,000 rpm, followed by filtration under reduced pressures, thus obtaining a wet cake (iv). The wet cake (iv) is mixed with 300 parts of ion-exchange water by a TK HOMOMIXER for 10 minutes at a revolution of 12,000 rpm, followed by filtration, thus obtaining a wet cake (v). The wet cake (v) is mixed with 300 parts of ion-exchange water by a TK HOMOMIXER for 10 minutes at a revolution of 12,000 rpm, followed by filtration. This operation is repeated twice, thus obtaining a wet cake (vi). The wet cake (vi) is mixed with 20 parts of a 10% hydrochloric acid by a TK HOMOMIXER for 10 minutes at a revolution of 12,000 rpm. Thereafter, a 5% methanol solution of a fluorine-containing quaternary ammonium salt (FUTARGENT F-310 from Neos Company Limited) is added so that the resulting mixture includes 0.1 parts of the fluorine-containing quaternary ammonium salt based on 100 parts of the solid constituents. The mixture is further agitated for 10 minutes, followed by filtration, thus obtaining a wet cake (vii). The wet cake (vii) is mixed with 300 parts of ion-exchange water by a TK HOMOMIXER for 10 minutes at a revolution of 12,000 rpm, followed by filtration. This operation is repeated twice, thus obtaining a wet cake (viii).

The wet cake (viii) is dried by a circulating drier for 36 hours at 40° C. and filtered with a mesh having openings of 75 μm. Thus, a mother toner 1 is prepared. The mother toner 1 in an amount of 100 parts is mixed with 1.5 parts of a hydrophobized silica (TS720 from Cabot Corporation) by a HENSCHEL MIXER for 5 minutes at a revolution of 3,000 rpm. Thus, a toner 1 is prepared. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 1 are measured. The results are shown in Table 4-1.

Example 2

Preparation of Toner 2

The procedure for preparation of the toner 1 in Example 1 is repeated to prepare a toner 2 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 2 are similarly measured. The results are shown in Table 4-1.

Example 3

Preparation of Toner 3

The procedure for preparation of the toner 1 in Example 1 is repeated to prepare a toner 3 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 3 are similarly measured. The results are shown in Table 4-1.

Example 4

Preparation of Toner 4

The procedure for preparation of the toner 1 in Example 1 is repeated to prepare a toner 4 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 4 are similarly measured. The results are shown in Table 4-1.

Example 5

Preparation of Toner 5

The procedure for preparation of the toner 1 in Example 1 is repeated to prepare a toner 5 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 5 are similarly measured. The results are shown in Table 4-1.

Example 6

Preparation of Toner 6

The procedure for preparation of the toner 1 in Example 1 is repeated to prepare a toner 6 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 6 are similarly measured. The results are shown in Table 4-1.

Example 7

Preparation of Toner 7

The procedure for preparation of the toner 1 in Example 1 is repeated to prepare a toner 7 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 7 are similarly measured. The results are shown in Table 4-1.

Example 8

Preparation of Toner 8

The procedure for preparation of the toner 1 in Example 1 is repeated to prepare a toner 8 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 8 are similarly measured. The results are shown in Table 4-1.

Comparative Example 1

Preparation of Toner 9

The procedure for preparation of the toner 1 in Example 1 is repeated to prepare a toner 9 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 9 are similarly measured. The results are shown in Table 4-1.

Comparative Example 2

Preparation of Toner 10

The procedure for preparation of the toner 1 in Example 1 is repeated to prepare a toner 10 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 10 are similarly measured. The results are shown in Table 4-1.

Comparative Example 3

Preparation of Toner 11

The procedure for preparation of the toner 1 in Example 1 is repeated to prepare a toner 11 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 11 are similarly measured. The results are shown in Table 4-1.

Comparative Example 4

Preparation of Toner 12

The procedure for preparation of the toner 1 in Example 1 is repeated to prepare a toner 12 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 12 are similarly measured. The results are shown in Table 4-1.

Comparative Example 5

Preparation of Toner 13

The procedure for preparation of the toner 1 in Example 1 is repeated to prepare a toner 13 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 13 are similarly measured. The results are shown in Table 4-1.

Comparative Example 6

Preparation of Toner 14

The procedure for preparation of the toner 1 in Example 1 is repeated to prepare a toner 14 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 14 are similarly measured. The results are shown in Table 4-1.

Comparative Example 7

Preparation of Toner 15

The procedure for preparation of the toner 1 in Example 1 is repeated to prepare a toner 15 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 15 are similarly measured. The results are shown in Table 4-1.

Comparative Example 8

Preparation of Toner 16

The procedure for preparation of the toner 1 in Example 1 is repeated to prepare a toner 16 except for changing the binder resin and the crystalline polyester resin as shown in Table 4-1. A ratio (I1/I2) of an intensity of the peak originated from an crystalline resin to an intensity (I2) of a halo originated from an amorphous composition, an average domain size, a Tg, and Tg−[TgA×MA/(MA+MB)+TgB×MB/(MA+MB)] of the toner 16 are similarly measured. The results are shown in Table 4-1.

TABLE 4-1

| | | CP | CCP | I1/I2 | Binder Resin | Tg | ADS (nm) | Tg− |
|---|---|---|---|---|---|---|---|---|
| Example 1 | Toner 1 | C1 | 2.5 | 0.2 | 1 | 37 | 35 | 1.8 |
| Example 2 | Toner 2 | C1 | 3 | 0.3 | 1 | 36 | 35 | 0.8 |
| Example 3 | Toner 3 | C1 | 5 | 0.5 | 1 | 35 | 35 | −0.2 |
| Example 4 | Toner 4 | C1 | 7 | 0.8 | 1 | 34 | 35 | −1.2 |
| Example 5 | Toner 5 | C1 | 10 | 1 | 1 | 33 | 35 | −2.2 |
| Example 6 | Toner 6 | C2 | 2.5 | 0.2 | 2 | 30 | 42 | −1.5 |
| Example 7 | Toner 7 | C2 | 5 | 0.5 | 2 | 28 | 42 | −3.5 |
| Example 8 | Toner 8 | C2 | 10 | 1 | 2 | 26 | 42 | −5.5 |
| Comparative Example 1 | Toner 9 | C1 | 0 | 0 | 1 | 39 | 35 | 3.8 |
| Comparative Example 2 | Toner 10 | C1 | 0.5 | 0.05 | 1 | 39 | 35 | 3.8 |
| Comparative Example 3 | Toner 11 | C1 | 1.5 | 0.1 | 1 | 38 | 35 | 2.8 |
| Comparative Example 4 | Toner 12 | C1 | 12 | 1.1 | 1 | 33 | 35 | −2.2 |
| Comparative Example 5 | Toner 13 | C1 | 15 | 1.2 | 1 | 32 | 35 | −3.2 |
| Comparative Example 6 | Toner 14 | C2 | 0 | 0 | 2 | 33 | 42 | 1.5 |
| Comparative Example 7 | Toner 15 | C2 | 1 | 0.1 | 2 | 32 | 42 | 0.5 |
| Comparative Example 8 | Toner 16 | C2 | 15 | 1.2 | 2 | 25 | 42 | −6.5 |

CP: Crystalline Polyester
CCP: Content of Crystalline Polyester (parts by weight)
ADS: Average Domain Size
Tg−: Tg − [TgA × MA/(MA + MB) + TgB × MB/(MA + MB)]

—Preparation of Carrier—

A coating layer forming liquid is prepared by dispersing 100 parts of a silicone resin (SR2411 from Dow Corning Toray Co., Ltd.), 5 parts of γ-(2-aminoethyl) aminopropyl trimethoxysilane, and 10 parts of a carbon black in 100 parts of toluene by a homomixer for 20 minutes. The coating layer forming liquid is applied to the surfaces of 1,000 parts of magnetite particles having a volume average particle diameter of 50 μm using a fluidized bed coating device. Thus, a magnetic carrier is prepared.

—Preparation of Developers—

Each of the toners 1 to 8 and comparative toners 1 to 8 in an amount of 5 parts and the carrier in an amount of 95 parts are mixed with a ball mill. Thus, two-component developers 1 to 8 and comparative two-component developers 1 to 8 are prepared.

These two-component developers are subjected to the following evaluations of (a) image density, (b) heat-resistant storage stability, (c) fixability, (d) toner filming, (e) background fouling, (f) toner scattering, (g) haze factor and (h) environmental stability. The evaluation results are shown in Table 4-2.

(a) Evaluation of Image Density

Each developer is mounted on a tandem full-color electrophotographic apparatus (IMAGIO NEO 450 from Ricoh Co., Ltd.), and a solid image having 1.00±0.05 mg/cm$^2$ of toner is formed on a sheet of a paper TYPE 6000 <70W> (from Ricoh Co., Ltd.) while setting the temperature of the fixing roller to 160±2° C. Six randomly-selected portions in the solid image are subjected to a measurement of image density with a spectrophotometer (938 spectrodensitometer from X-Rite). The measured image density values are averaged and graded as follows.

Image Density Grades
Good: not less than 2.0
Fair: not less than 1.70 and less than 2.0
Poor: less than 1.70

(b) Evaluation of Heat-Resistant Storage Stability (Penetration)

A 50-ml glass vial is filled with each toner and left in a constant-temperature chamber at 50° C. for 24 hours, followed by cooling to 24° C. The toner is then subjected to a penetration test based on JIS K-2235-1991. Penetration (mm) represents how deep the needle penetrates the above toner in the vial. The greater the penetration, the better the heat-resistant storage stability of the toner. A toner with a penetration less than 5 mm may be not commercially viable.

Penetration Grades
Excellent: not less than 25 mm
Good: not less than 15 mm and less than 25 mm
Fair: not less than 5 mm and less than 15 mm
Poor: less than 5 mm (c) Evaluation of Fixability A copier (MF-200 from Ricoh Co., Ltd.) employing a TEFLON® fixing roller is modified so that the temperature of the fixing roller is variable. Each developer is mounted on the copier, and a solid image having 0.85±0.1 mg/cm$^2$ of toner is formed on sheets of a normal paper TYPE 6200 (from Ricoh Co., Ltd.) and a thick paper <135> (from NBS Ricoh) while varying the temperature of the fixing roller to determine the maximum and minimum fixable temperatures. The maximum fixable temperature is a temperature above which hot offset occurs on the normal paper. The minimum fixable temperature is a temperature below which the residual rate of image density after rubbing the solid image falls below 70% on the thick paper.

Maximum Fixable Temperature Grades
Excellent: not less than 190° C.
Good: not less than 180° C. and less than 190° C.
Fair: not less than 170° C. and less than 180° C.

Poor: less than 170° C.

Minimum Fixable Temperature Grades

Excellent: less than 125° C.

Good: not less than 125° C. and less than 135° C.

Fair: not less than 135° C. and less than 145° C.

Poor: not less than 145° C.

(d) Evaluation of Toner Filming 200,000 images each having an image area by 20% are produced so as to have an image density of 1.4±0.2 mg/cm$^2$ with each of the developers, using a tandem color image forming apparatus Imagio neo 450 from Ricoh Company, Ltd. The charge quantity (μc/g) of the developer before and after 200,000 images are produced are measured by a blowoff method to see the loss thereof after 200,000 images were produced.

Excellent: less than 15%

Good: not less than 15% and less than 30%

Fair: not less than 30% and less than 50%

Poor: not less than 50%

When a toner films a carrier, the charge quantity lowers. The less the loss, the less the toner films the carrier.

(e) Evaluation of Background Fouling 200,000 images each having an image area of 5% are continuously produced by a tandem color image forming apparatus Imagio neo 450 from Ricoh Company, Ltd. to visually (with a loupe) observe the background of the last image whether contaminated with the toner.

Good: No background fouling

Fair: Slight background fouling, but no problem in practical use

Poor: Serious background fouling and a problem in practical use (f) Toner Scattering 200,000 images each having an image area of 5% are continuously produced by a tandem color image forming apparatus Imagio neo 450 from Ricoh Company, Ltd. to visually (with a loupe) observe the apparatus whether contaminated with the toner.

Excellent: no toner contamination is observed

Good: slight contamination without problems

Fair: contamination is observed, but no problem in practical use

Poor: Serious contamination and a problem in practical use (g) Haze Factor

An image is produced on an OHP sheet type PPC-DX from Ricoh Company, Ltd. while the fixing belt has a surface temperature of 160° C. A haze factor of the image was measure by a direct reading haze factor computer HGM-2DP from Suga Test Instruments Co., Ltd. The haze factor is also called cloudiness and represents transparency of a toner. The smaller the haze factor, the higher the transparency, and colorability of a toner on an OHP sheet improves.

Excellent: less than 20%

Good: not less than 20% and less than 30%

Poor: not less than 30%

(h) Environmental Stability

After the developer was stirred by a ball mill for 5 min in an environment of 23° C. and 50% R/H. (M/M environment), a charge quantity of 1.0 g of the developer was measured by a blow-off charge quantity measurer TB-200 from Toshiba Chemical Corp. after subjected to nitrogen blow for 1 min. The charge quantity in each of an environment of 40° C. and 90% R/H. (H/H environment) and an environment of 10° C. and 30% R/H. (L/L environment) was also measured to determine an environmental variation by the following formula. The less the variation, the more stable chargeability the developer has.

$$\text{Environmental variation}=2\times(L/L-H/H)/(L/L+H/H)\times 100(\%)$$

Excellent: less than 10%

Good: Not less than 10% and less than 30%

Fair: Not less than 30% and less than 50%

Poor: Not less than 50%

TABLE 4-2

| | | (a) | (b) | (c) min. | (c) max. | (d) | (e) | (f) | (g) | (h) |
|---|---|---|---|---|---|---|---|---|---|---|
| Example 1 | Toner 1 | G | E | E | E | E | G | E | E | E |
| Example 2 | Toner 2 | G | E | E | E | E | G | E | E | E |
| Example 3 | Toner 3 | G | E | E | E | E | G | E | E | E |
| Example 4 | Toner 4 | G | E | E | E | E | G | E | E | E |
| Example 5 | Toner 5 | G | E | E | E | E | G | E | E | E |
| Example 6 | Toner 6 | G | G | E | G | G | F | E | E | E |
| Example 7 | Toner 7 | G | G | E | G | G | F | E | E | E |
| Example 8 | Toner 8 | G | G | E | G | G | F | E | E | E |
| Comparative Example 1 | Toner 9 | G | E | G | E | E | G | E | E | E |
| Comparative Example 2 | Toner 10 | G | E | G | E | E | G | E | E | E |
| Comparative Example 3 | Toner 11 | G | E | G | E | E | G | E | E | E |
| Comparative Example 4 | Toner 12 | G | P | E | E | E | G | E | E | E |
| Comparative Example 5 | Toner 13 | G | P | E | E | E | G | E | E | E |
| Comparative Example 6 | Toner 14 | G | G | G | G | G | F | E | E | E |
| Comparative Example 7 | Toner 15 | G | G | G | G | G | F | E | E | E |
| Comparative Example 8 | Toner 16 | G | P | E | G | G | F | E | E | E |

E: excellent;
G: good;
F: fair;
P: poor

A toner including a resin including a polyhydroxycarboxylic acid backbone and a polyester resin formed of polybasic acid and polyol adhering to the surface of the resin has good fixability, image density, haze factor and environmental stability. When the resin adhering thereto is not suitable, the environmental stability deteriorates.

The quantity of the crystalline polyester largely influences upon the fixability. When less than 2.5% by weight, Tg decreases but the minimum fixable temperature is not improved. When greater than 15% by weight, the minimum fixable temperature is improved, but the environmental stability deteriorates.

Suitably controlling the quantity of the crystalline polyester largely improves the minimum fixable temperature and maintains the environmental stability.

Having now fully described the invention, it will be apparent to one of ordinary skill in the art that many changes and modifications can be made thereto without departing from the spirit and scope of the invention as set forth therein.

What is claimed is:

1. A toner having a glass transition temperature (Tg) observed at least at one point from 25 to 65° C. in a differential scanning calorimeter at a rate of temperature increase of 5° C./min, and comprising:

a binder resin having an amorphous composition and comprising:

a polyester backbone A, which is a polylactic acid backbone; and a polyester backbone B comprising an alcohol component and an acidic component, wherein the acidic component comprises a multivalent carboxylic acid having three or more valences; and a crystalline resin, which is an aliphatic polyester, wherein the toner has a structure in which a high phase difference image corresponding to the polyester backbone B is dispersed a low phase difference image corresponding to the polyester backbone A in a two-dimensional phase difference image observed by tapping mode AFM, wherein an X-ray diffraction chart in which a peak originated from the crystalline resin is observed in a range of a diffraction angle 2θ of from 20 to 25°, and wherein a ratio (I1/I2) of an intensity of the peak originated from the crystalline resin to an intensity (I2) of a halo originated from the amorphous composition is from 0.2 to 1.

2. The toner of claim 1, wherein an average domain size in a dispersion phase of the high phase difference is not less than 10 nm and less than 45 nm.

3. The toner of claim 1, wherein the binder resin is a block copolymer of the polyester backbone A and the polyester backbone B, wherein the polyester backbone B does not have a repeating unit obtained from a dehydration condensation of a polyhydroxycarboxylic acid, and wherein the binder resin satisfies the relationship:

$$-5 \leq Tg-[TgA \times MA/(MA+MB)+TgB \times MB/(MA+MB)] \leq 5$$

wherein:

TgA is the Tg of the polyester backbone A;

TgB is the Tg of the polyester backbone B;

MA is the weight ratio of the polyester backbone A in the block copolymer; and

MB is the weight ratio of the polyester backbone B in the block copolymer.

4. The toner of claim 1, wherein the alcohol component of the polyester backbone B comprises 3-methyl-1,5-pentanediol.

5. The toner of claim 3, wherein the polyester backbone B comprises a branched structure.

6. The toner of claim 1, wherein the polyester backbone B comprises the multivalent carboxylic acid in an amount not less than 1.5 mol %.

7. The toner of claim 6, wherein the multivalent carboxylic acid is a trimellitic acid.

8. The toner of claim 1, wherein the polyester backbone A is obtained by ring-opening polymerizing a mixture of an L-lactide and a D-lactide.

9. The toner of claim 1, wherein the polyester backbone A is obtained by dehydration condensation of lactic acid, wherein an optical isomer ratio X (%) at a monomer component conversion, represented by the following formula, is not greater than 80%:

$$X(\%)=|X(L\text{-form})-X(D\text{-form})|$$

wherein X(L-form) and X(D-form) represent ratios (%) of L-form and D-form at a polylactic monomer conversion, respectively.

10. The toner of claim 3, wherein the binder resin comprises the polyester backbone B in an amount of from 5 to 25% by weight.

11. The toner of claim 3, wherein the polyester backbone B in the binder resin has a number-average molecular weight not less than 1,000 and less than 3,000.

12. The toner of claim 1, wherein the binder resin has a number-average molecular weight not greater than 20,000.

13. A developer, comprising:

the toner of claim 1; and a carrier.

* * * * *